US012338055B2

(12) United States Patent
Domingos

(10) Patent No.: US 12,338,055 B2
(45) Date of Patent: Jun. 24, 2025

(54) SLEEVES FOR CUPS AND OTHER CONTAINERS, AND METHODS OF MANUFACTURING SAME

(71) Applicant: Jared Domingos, Scotia, NY (US)

(72) Inventor: Jared Domingos, Scotia, NY (US)

( * ) Notice: Subject to any disclaimer, the term of this patent is extended or adjusted under 35 U.S.C. 154(b) by 0 days.

(21) Appl. No.: 18/465,553

(22) Filed: Sep. 12, 2023

(65) Prior Publication Data

US 2024/0002132 A1 Jan. 4, 2024

Related U.S. Application Data

(63) Continuation of application No. PCT/US2022/020276, filed on Mar. 14, 2022, and a continuation-in-part of application No. 17/199,795, filed on Mar. 12, 2021, now Pat. No. 11,814,236, said application No. PCT/US2022/020276 is a continuation-in-part of application No. 17/199,795, filed on Mar. 12, 2021, now Pat. No. 11,814,236.

(51) Int. Cl.
*B65D 81/38* (2006.01)

(52) U.S. Cl.
CPC ..... *B65D 81/3876* (2013.01)

(58) Field of Classification Search
CPC ..... B65D 81/3886; B65D 81/3876; B65D 81/38; B65D 3/22; A47K 10/16; B32B 3/10; B32B 29/005; B32B 29/002; B32B 2307/304; B31C 7/00
USPC ..... 220/739, 737, 738, 903; 229/403; 206/812; 493/296
See application file for complete search history.

(56) References Cited

U.S. PATENT DOCUMENTS 4,194,627 A 3/1980 Christensen
5,174,965 A 12/1992 Jones
5,445,315 A 8/1995 Shelby
(Continued)

FOREIGN PATENT DOCUMENTS

WO 2019009812 1/2019

OTHER PUBLICATIONS

YouTube.com Webpage/Video, "How to Fold a Wine Bottle Drip Guard from a Paper Towel", uploaded by @NickelAndDimeWine on Feb. 13, 2011, available https://www.youtube.com/watch?v=TdB0alzi3KM, See 0.45-1:35.

*Primary Examiner* — Robert J Hicks
(74) *Attorney, Agent, or Firm* — Heslin Rothenberg Farley & Mesiti P.C.

(57) ABSTRACT

Sleeves for containers (e.g., cups), and methods of manufacturing such sleeves, are presented. The sleeves are configured to be utilized as a thermal protective and liquid absorbent container/cup sleeve, or as a napkin, towel or the like. The sleeves are selectively manually configurable between the container/cup sleeve and napkin configurations. When configured as a container/cup sleeve, the sleeve is formed of at least one sheet of material that is freely folded into an annular shape with an inner cavity adapted to receive a cup container/cup therein, and to engage with an outer periphery of the container/cup. The sheet of material is adapted to provide thermal protection, and is liquid absorbent. In the sleeve configuration, one end portion of the sheet of material is folded over the other end portion such that the sleeve arrangement is maintained and the sleeve includes at least three layers of the material.

20 Claims, 25 Drawing Sheets

(56) References Cited

U.S. PATENT DOCUMENTS

| | | | | |
|---|---|---|---|---|
| 6,286,754 | B1 | 9/2001 | Stier | |
| 8,668,109 | B2 | 3/2014 | Dickert | |
| 2002/0000446 | A1 | 1/2002 | Taylor | |
| 2002/0185496 | A1 | 12/2002 | Puerini | |
| 2009/0302047 | A1 | 12/2009 | Anderson | |
| 2012/0145732 | A1 | 6/2012 | Padek | |
| 2012/0234846 | A1 | 9/2012 | Costanzo, Jr. | |
| 2012/0318812 | A1 | 12/2012 | Leser | |
| 2013/0213986 | A1 | 8/2013 | Couvelier | |
| 2014/0038804 | A1 | 2/2014 | Konkin | |
| 2014/0151385 | A1 | 6/2014 | Chun | |
| 2015/0291313 | A1 | 10/2015 | Vara | |
| 2017/0273485 | A1 | 9/2017 | Rao | |
| 2021/0292079 | A1* | 9/2021 | Wong | B32B 7/04 |
| 2022/0007675 | A1* | 1/2022 | Park | B65D 85/78 |

* cited by examiner

SLEEVES FOR CUPS AND OTHER CONTAINERS, AND METHODS OF MANUFACTURING SAME

CROSS-REFERENCE TO RELATED APPLICATION

This application is a by-pass continuation of PCT International Application No. PCT/US2022/020276, filed on Mar. 14, 2022, and entitled Sleeves for Cups and Other Containers, and Methods of Manufacturing Same, which application perfects and claims priority benefit of U.S. patent application Ser. No. 17/199,795, entitled Sleeve for Cups and Other Containers, filed on Mar. 12, 2021, and this application is a continuation-in-part of U.S. patent application Ser. No. 17/199,795, entitled Sleeve for Cups and Other Containers, filed on Mar. 12, 2021, which are each hereby incorporated herein by reference in their entireties.

TECHNICAL FIELD

The invention relates generally to sleeves for containers, and more particularly to a sleeves adapted to extend about cups or other like containers that is configured to allow a person to hold the cup/container while providing thermal insulation between the person's hand and the cup/container, and has an absorbency sufficient to absorb liquids that may condense on and/or leave the cup/container.

BACKGROUND

Sleeves for containers that are typically held or handled, such as cups, mugs and the like, and are commonly used in coffee shops and restaurants around the world. Most disposable cups are too thin to provide adequate heat protection. Therefore, a cup sleeve is placed around a cup holding a hot beverage therein to make more comfortable for a user to hold the cup. U.S. Pat. No. 5,425,497 to Jay Sorensen illustrates a typical current hot beverage or coffee sleeve.

Existing cup sleeves are single-use products with no other functions, and accordingly are typically discarded after use (e.g., with a cup). Current cup sleeves are typically made of paperboard or similar material. Many existing cup sleeves are manufactured or made from materials that have poor insulating properties, which cause users to use double-walled cups or two cups combined (known as "double-cupping"), which is wasteful and costly. Most existing cup sleeves also have a symmetrical shape that fails to provide insulation protection to the natural finger placement of the entire human hand when holding a cup or like container.

Many people, while holding or using a cup or like container that holds a liquid (or a partially liquid or wet substance), separately utilize a napkin (i.e., a liquid absorbent, flexible sheet of material) to absorb drips from the cup and/or to soak up spills from the cup. A napkin may be utilized around iced cups to absorb condensation or act as a coaster. Occasionally, with drink cups that include a lid that defines a dinking aperture or spout, a lid plugs is used to block the aperture, and thereby prevent unintended spills or splashes of liquid from inside the cup. However, the use of these multiple single-use products (e.g., cup sleeves, napkins and lid plugs) creates additional waste and expense (e.g., to an environment and/or food service provider).

To overcome one or more deficiencies of current drink/container sleeves and accessories, advantageous sleeves for containers (e.g., cups) that advantageously provide for both effective thermal insulation, and are liquid absorbent to serve as napkins, are disclosed. Further, the sleeves may also be advantageously configured to be readily removed from a container to be utilized as typical napkin.

While certain aspects of conventional technologies have been discussed to facilitate disclosure of Applicant's invention(s), the Applicant in no way disclaims these technical aspects, and it is contemplated that the invention(s) may encompass one or more conventional technical aspects.

In this disclosure, an act or item of knowledge is referred to or discussed, this reference or discussion is not an admission that the act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The present inventions may address one or more of the problems and deficiencies of current thermal insulative cup sleeves. However, it is contemplated that the inventions may prove useful in addressing other problems and deficiencies in a number of technical areas. Therefore, the claimed invention(s) should not necessarily be construed as limited to addressing any of the particular problems or deficiencies discussed herein.

In accordance with one aspect of the present disclosure, a liquid absorbent thermal insulating sleeve configured for use with a container or cup is disclosed. The cup sleeve includes a material folded into a shape adapted to receive a cup and to engage with an outer circumference of the cup. The material is adapted to provide thermal protection. The cup sleeve includes a first section having a selected number of overlapping layers of the material, and a second section having three times the selected number of overlapping layers of the material.

In one embodiment, the cup sleeve includes no adhesive material (and thereby void of an adhesive that bonds overlapping layers of the material together). The foldable material has absorbent properties (i.e., is substantially absorbent to liquid, such as water). The cup sleeve has an assembled initial folded position that retains its shape for distribution to users. The cup sleeve is adapted to retain its the shape while engaged with the outer surface (e.g., circumference) of the cup, and the sleeve is further adapted to be unfolded into a third shape adapted to function as an absorbent napkin or towel.

In some embodiments, the cup sleeve has an upper edge having a first point/portion and a second point/portion, the second point/portion being higher than the first point/portion when the cup sleeve is engaged with the outer circumference of the cup or otherwise in an open configuration (i.e., arranged such that the sleeve defines an open inner opening, cavity or gap) (and potentially in second folded position). The cup sleeve may further include a section/portion proximate to the second point that, when the cup sleeve is engaged with the outer circumference of the cup otherwise in an open configuration, is positioned higher than the first point.

In some embodiments, the material forming the sleeve is a substantially liquid absorbent sheet of material. In some such embodiments, the material is a textured sheet of material. In some embodiments, the substantially liquid absorbent sheet of material is a napkin.

In some embodiments, the cup sleeve is formed from/by an elongate sheet of liquid absorbent material having a total length between about 12 and about 14 inches, and/or a total width between about 8 and about 11 inches. For example, the cup sleeve may be formed from a sheet of material having a length of 13 inches and a width of about 10 inches. The sheet of material may be folded or otherwise layers, for example, to form an elongate strip with a total length between about 10 and about 16 inches (e.g., about 12 and about 14 inches), and a total width between about 1 and about 5 inches (e.g., between about 1-½ and 3½ inches, or between about 2 and 3 inches). Other dimensions may be used such as any dimension resulting in a sheet or sheet-like material with two long sides and two short sides (e.g., a generally rectangular shape).

It is noted that the sheet of liquid absorbent material may be folded upon itself one or more times to form the elongate shape, and thereby include a plurality of overlapping layers. In such embodiments, the sheet of liquid absorbent material may be freely folded over upon itself such that the layers are not adhered or coupled together such that the sheet can be freely manually unfolded (e.g., along a height direction) from the elongate shape that forms the sleeve construct into a larger (e.g., larger along the width, length and/or height directions to define a relatively larger surface area). In this way, the sheet of liquid absorbent material may be freely selectively manually unfolded or reconfigured from the sleeve configuration or arrangement into a larger napkin configuration or arrangement.

In some embodiments, the elongate sheet of material forming the sleeve (e.g., a folded sheet of liquid absorbent material) may have a total length L (of a unit of measurement) of approximately 2 (W (Radical (3)))+2 (W), where W is the total width of the sheet of folded material in the unit of measurement. Stated differently, in some embodiments, the total length L (of a unit of measurement) of the elongate sheet of material forming the sleeve (e.g., a folded sheet of liquid absorbent material) may be equal to 2 (WV3)+2W, where L is total length (in a unit of measurement) and W is the total width of the folded material (in the unit of measurement). In some embodiments, the elongate sheet of absorbent material forming the sleeve may define/have a total length ratio of 1 short side unit to about 5.5 long side units (or about 0.18 short side to long side units).

In some embodiments, the sleeve has a first folded position, arrangement or configuration that defines an annular sleeve shape with an inner opening configured to accept a container (e.g., a cup, such as a cup with a conically-shaped outer wall) therein such that the sleeve extends about the exterior side wall of the container, and a second open position wherein the sleeve does not define the annular sleeve shape and serves as a napkin In the first container/cut sleeve configuration, the sleeve is adapted to receive a cup and engage with the outer circumference of the cup.

In some embodiments, in the first arrangement, the sleeve defines a first portion that extends annularly (e.g., ring shaped (of any cross-sectional shape, such as circular, elliptical or other shape)) about the inner opening (i.e., and thereby a container positioned thereon), and a second portion that is folded/extended over a portion of the first portion (e.g., the top or bottom edge thereof that defines the width) such that the first portion is positioned between inner and outer portions of the second portion (e.g., in the thickness direction). As such, an inner portion of the second portion may be positioned between the inner cavity/container and the first portion, and the second portion may be positioned between the inner portion and an outer portion of the second portion. The sleeve, in the first arrangement, may thereby comprise at least three overlapped layers of the sheet of absorbent material along a portion thereof. Further, as disclosed above and in further detail below, the sheet of material may be folded or otherwise comprise multiple overlapping layers. In such embodiments, each of the three overlapped layers of the sheet of absorbent material may comprise one or more layers of the sheet of absorbent material, and thereby the overlapped portions of the sleeve in the first arrangement may comprise three, six, nine, etc. total overlapped layers of the absorbent material.

In some embodiments, the first portion of the sleeve may comprise a first portion of the sleeve extending along the length thereof from a first longitudinal end, and the second portion of the sleeve may comprise a second portion of the sleeve extending along the length thereof from a second longitudinal end to the first portion. In some such embodiments, the second portion of the sleeve may be folded over the top (or bottom) edge of a portion of the first portion that is proximate to the first end (e.g., a portion extending longitudinally from the first end toward the second end).

In accordance with another aspect of the disclosure, a method for manufacturing or making a liquid absorbent thermal insulating container/cup sleeve is disclosed. In some embodiments, the method comprises layering, such as by folding, a sheet of absorbent material, a selected number of times to produce a multi-layer sheet of material having two long sides and two short sides.

The method then comprises defining a triangular section of the layered sheet of material at one end along the length thereof (i.e., at portion the sheet of material proximate to/extending from one the short side edges). The triangular section may comprise a triangular corner portion of the sheet of material that includes a short side edge and portion of the top or bottom long side edge. The method comprises folding/layering the triangular section over an inner face of the sheet of material from the hypotenuse of the triangular section (the hypotenuse thereby being a fold or folded edge). The folded-over triangular section may have a first side having a total length W formed from the short side of the layered/folded material, and a second diagonal side formed from a portion of the top or bottom end of the long side of the layered/folded material (depending on if the hypotenuse/fold line extends from the bottom or top corner of the end of the material, respectively).

In some embodiments, the second diagonal side of the folded-over triangular section may comprise a length of WV3, and the hypotenuse may comprise a length 2W, where W is the width of the material along the short side (and the short side defines the first side of the triangular section (which is a shortest side), for example). The intersection of the first side and the hypotenuse may form an angle which may be, in some exemplary embodiments, about 50-70 degrees (e.g., about 60 degrees), and the intersection of the second diagonal side and the hypotenuse forms an angle which may be, in some exemplary embodiments, about 10-40 degrees (e.g., about 30 degrees). These angles are exemplary and not disclosed in a limiting sense, as the method may utilize other differing angles.

In some embodiments, the folding over of the triangular section about/along the hypotenuse thereof forms first folded-over overlapping sections with the diagonal edge of the triangular section extending from the top (or bottom) long side edge of the sheet of material toward the second short side end edge and the bottom (or top) long side edge thereof. In some such embodiments, the fold/hypotenuse of the triangular section may extend between and intersect with the top and bottom long side edges of the sheet of material, and/or the diagonal edge of the first folded-over section extends past the bottom (or top) long side edge. For example, in some embodiments, the hypotenuse may extend from the top long side edge to the corner/junction of the respective short side edge and the bottom long side edge, and the diagonal edge of the first folded-over triangular section may extend to and past the bottom long side edge. In such an embodiment, the first side (W) of the triangular section (i.e., the respective short side of the sheet of material) extends downwardly past the bottom long side edge and toward the other short end side of the material.

In some embodiments, the method may further comprise folding the first folded-over overlapping sections of the sheet of material (i.e., the triangular section and the portion of the sheet of material extending beneath/under or overlapped with the triangular section) over the inner face of an adjacent medial portion of the sheet of material such that the hypotenuse edge of the triangular section (i.e., the first fold line) is substantially aligned with and extend along the top (or bottom) long side edge of the material (depending on if the hypotenuse/fold line extends from the bottom or top corner of the end of the material, respectively), to form second folded-over overlapping sections. The second folded-over overlapping sections thereby may comprise the first folded-over overlapping sections as a set of outer layers formed of the sheet of material, and the medial portion of the sheet of material as at least one inner layer formed of the sheet of material.

In some embodiments, the first folded-over overlapping sections are folded over the inner face of the adjacent medial portion of the sheet of material toward the first short side of the sheet of material to form the second folded-over overlapping sections. For example, the first folded-over overlapping sections may be folded over the inner face of the adjacent medial portion of the sheet of material toward the first short side of the sheet of material via a second fold line that extends from the junction/intersection of the second diagonal side of the triangular section and the top long side edge (or bottom long side edge). In such an embodiment, the second folded-over overlapping sections may thereby comprise the entirety of the triangular section of the first folded-over overlapping sections overlapped with the medial section/portion of the sheet of material. Further, the second fold line may thereby be non-perpendicular to the top and bottom long sides of the sheet of material. For example, in such a configuration, the second fold line will be angled toward the first short side end of the sheet of material as it extends across the width of the sheet away from the junction/intersection of the second diagonal side of the triangular section and the respective long side edge extending therefrom and the opposing long side edge (e.g., as it extends from the top long side edge to the bottom long side edge).

The method further comprises folding over a first end section of the sheet of material extending from the first short end of the sheet of material over the inner face of the adjacent medial portion of the sheet and inserting/positioning the end section between the second folded-over overlapping sections, to form an annular or ring shaped sleeve member from/by the sheet of material that defines an inner cavity that is configured to receive a cup/container therein such that the sleeve member extends about the cup/container. For example, the first end section may be folded over the medial portion via/at a third fold line that extends perpendicularly between the top and bottom long sides of the sheet of material, and that may extend from at or adjacent to the tip/corner of the third side (W) and the hypotenuse of the triangular portion. Further, the top (or bottom) long side edge of the first end section may abut and extend along (e.g., parallel with) the interior of the first fold line (the hypotenuse of the triangular portion).

The inner face of the medial portion, and portions of the inner faces of the first end section and the triangular section, may thereby cooperatively form the inner cavity and engage the cup/container when positioned therein. Further, the inner cavity may define an axis, and the inner cavity (and thereby the faces of the sleeve material forming the cavity) may form a conical shape that extends outwardly away from the axis as it extends from the bottom side to the top side of the sheet of material/sleeve.

As noted above, the sheet of material is preferably a sheet of liquid absorbent material, such as paper towel, napkin or like material. The liquid (e.g., water) absorbency of the sheet of material may be markedly greater than that of cardboard or paperboard. The sheet of material may thereby form, and be able to be utilized as, a napkin or like device for absorbing liquid (e.g., spill or drips from the container/cup), during transport and when the sleeve is removed from the container/cup and manually disassembled or unfolded (at least partially). The sleeve may also absorb condensation from ice drink containers.

It should be appreciated that all combinations of the foregoing aspects and additional concepts discussed in greater detail below (provided such concepts are not mutually inconsistent) are contemplated as being part of the inventive subject matter and to achieve the advantages disclosed herein.

These and other objects, features and advantages of this disclosure will become apparent from the following detailed description of the various aspects of the disclosure taken in conjunction with the accompanying drawings.

BRIEF DESCRIPTION OF THE DRAWINGS

These and other features, aspects, and advantages of the present disclosure will become better understood when the following detailed description is read with reference to the accompanying drawings, which are not necessarily drawn to scale (although generally dimensionally scaled accurately) and in which like reference numerals represent like aspects throughout the drawings, wherein.

DETAILED DESCRIPTION

Figure 1:
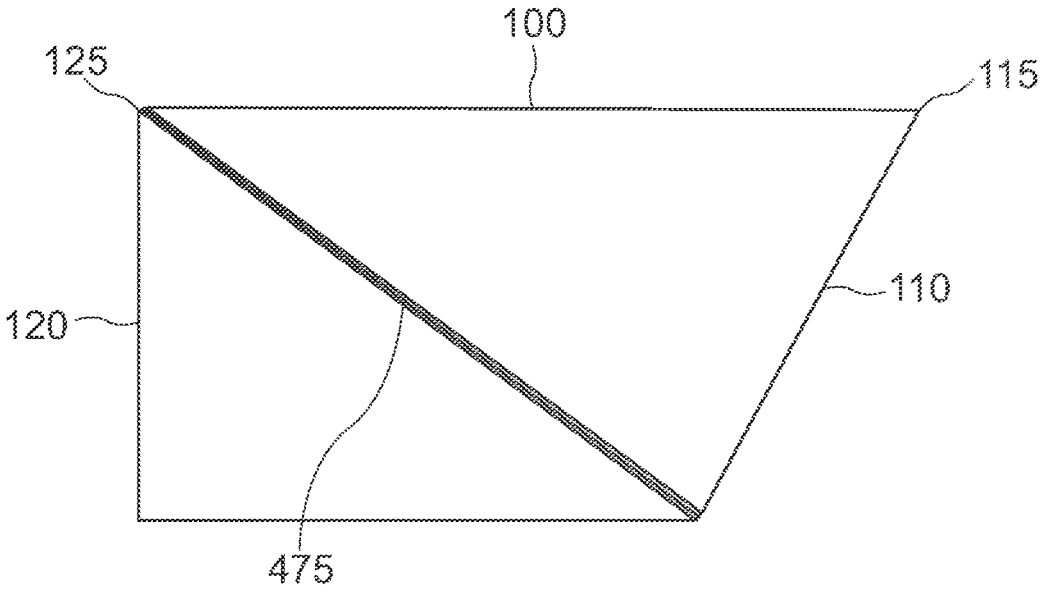
FIG. 1 illustrates a side view of an exemplary embodiment of cup sleeve in accordance with the present disclosure, in a first closed configuration.

Aspects of the present disclosure and certain examples, features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the disclosure, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to less than or equal to +5%, such as less than or equal to +2%, such as less than or equal to +1%, such as less than or equal to +0.5%, such as less than or equal to +0.2%, such as less than or equal to +0.1%, such as less than or equal to +0.05%. In some instances, the approximating language may correspond to the precision of an instrument for measuring the value. Any examples of operating or configuration parameters are not exclusive of other parameters of the disclosed embodiments.

Terminology used herein is for the purpose of describing particular examples only and is not intended to be limiting. As used herein, the singular forms "a", "an" and "the" are intended to include the plural forms as well, unless the context clearly indicates otherwise. Furthermore, references to "one example" are not intended to be interpreted as excluding the existence of additional examples that also incorporate the recited features. Moreover, unless explicitly stated to the contrary, the terms "comprising" (and any form of "comprise," such as "comprises" and "comprising"), "have" (and any form of "have," such as "has" and "having"), "include" (and any form of "include," such as "includes" and "including"), and "contain" (and any form of "contain," such as "contains" and "containing") are used as open-ended linking verbs. As a result, any examples that "comprises," "has," "includes" or "contains" one or more step or element possesses such one or more step or element, but is not limited to possessing only such one or more step or element.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

The term "coupled" and like terms are used herein to refer to both direct and indirect connections. As used herein and unless otherwise indicated, the term "entirety" (and any other form of "entire") means at least a substantial portion, such as at least 95% or at least 99%. The term "entirety" (and any other form of "entire"), as used herein, is thereby not limited to 100%, unless otherwise indicated. As used herein, the term "layer"

The terms "cup" and "container" are used synonymously herein to refer to a device that includes a cavity configured to contain material therein, such as but not limited to a liquid (e.g., aqueous) or partially-liquid substance therein, that is at a temperature above at least 100 degrees Fahrenheit. In some embodiment, the cup/container is specifically configured to contain a liquid beverage or other food product, such as but not limited to a beverage. While the exemplary cups/containers discussed and illustrated herein for reference are disclosed as having an outer wall of a circular cross-section, e.g., of a truncated cone shape, the sleeves of the present disclosure may be configured to extend about the outer wall of a cup/container of any shape (e.g., with a non-circular cross-section and/or non-conic shape) and size/dimensions. In some embodiment, a cup/container may include a wall portion that defines the outer shape of the cup/container, and the inner cavity, that define a vertical axis when a bottom side/surface of cup/container is positioned on a horizontal support surface (i.e., extends/oriented horizontally).

Components, aspects, features, configurations, arrangements, uses and the like described, illustrated or otherwise disclosed herein with respect to any particular embodiment may similarly be applied to any other embodiment disclosed herein.

Figure 2:
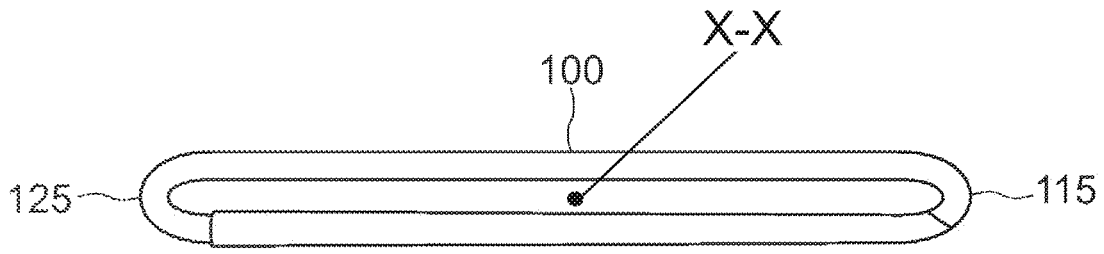
FIG. 2 illustrates a top view of the exemplary cup sleeve of FIG. 1 in the first closed configuration.
Figure 3:
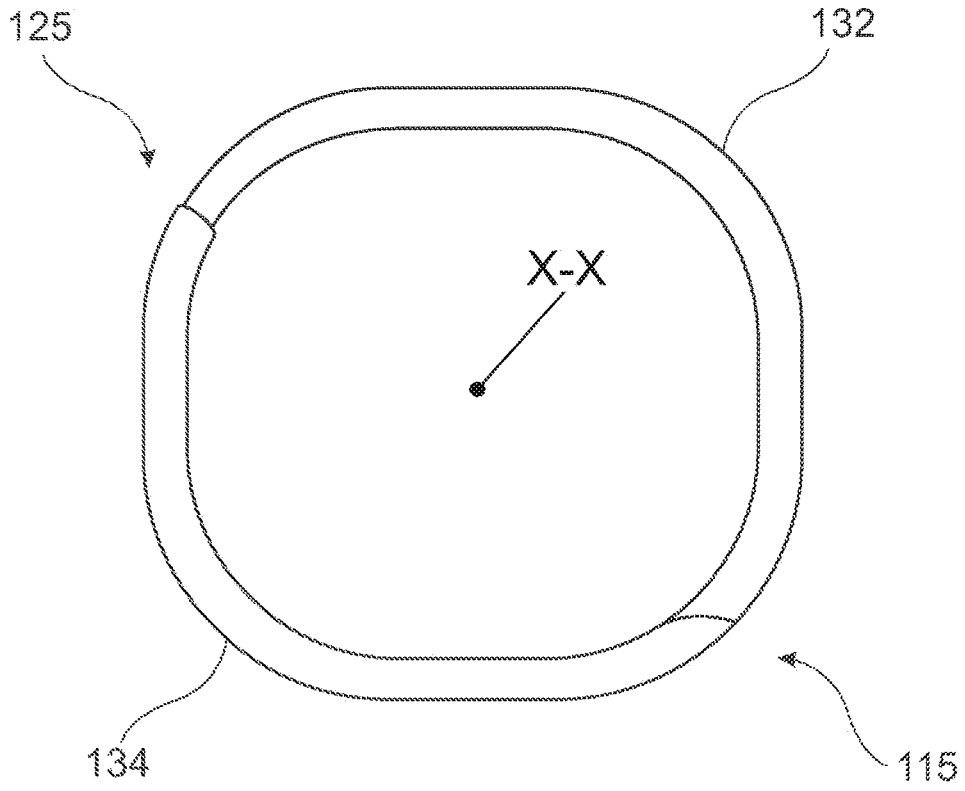
FIG. 3 illustrates a top view of the exemplary cup sleeve of FIG. 1 in an open configuration.

In accordance with the present disclosure, an exemplary pliable cup sleeve 100 formed by at least one sheet of material folded into an annular (i.e., ring-shaped) shape within an inner opening/cavity that is open at top and bottom sides of the sleeve and is adapted to receive a cup/container therein such that an inner side/face of the sleeve 100 engages with an outer circumference of a cup, as shown in FIGS. 1-9. The inner open cavity, and thereby the sleeve itself (e.g., the annular wall thereof) may define an axis X-X that extends through the top and bottom openings of the sleeve 100, as shown in FIGS. 2, 3 and 7A. The material is adapted to provide thermal protection and liquid absorbency of that of a napkin, towel or the like. As discussed in more detailed below, the sheet of material is folded in such a manner/configuration to form the annular shape with a first section thereof having a first number of layers of the material, and a second section thereof having a second number of layers of the material that is three times the first number of layers.

FIG. 1 shows a side view of a cup sleeve 100 in accordance with an embodiment. The sleeve 100 may be formed of at least one sheet of material. For example, cup sleeve 100 may be formed from at least one thermally insulative and high liquid absorbency sheet, such as a napkin, towel, tissue or like material. In some embodiments, the sheet of material may be a soft, thin, pliable, and absorbent paper sheet, such as a paper towel or airlaid paper napkin. For example, the absorbent sheet may comprise cellulose, and/or comprise a non-linting and/or non-static non-woven fabric. In some such embodiment, the sheet of material may also comprise a resin or other binder material configured to retain the structure of the sheet of material when is it wet. In some other embodiments, the sheet of material may comprise a woven fabric.

The sleeve 100 may be configured such that it can be readily selectively manually disassembled or reconfigured from the sleeve configuration to an "open" configuration such that the sheet of material can be used as a traditional napkin or towel. Further, in the sleeve configuration, the sleeve 100 may be configured to absorb drips/spills from the cup, and/or condensation that formed on the outside of the cup. The sleeve 100 can also be removed from the cup, and utilized as a napkin or towel without opening or disassembling the sleeve configuration.

The at least one sheet of material forming the sleeve 100 may thereby be configured such that it readily absorbs water and other liquids. The at least one sheet of material may thereby be a high liquid absorbency sheet, such as but not limited to a highly water absorbent paper sheet of material (i.e., a paper towel or napkin). In some embodiments, the sheet of material (per single layer of the sheet of material, or for the material as folded for the sleeve configuration (as discussed below)) has a water absorbency rate of at least 0.1 g/see, or at least 0.125 g/see, or at least 0.15 g/see, or at least 0.175 g/see, or at least 0.2 g/see, or at least 0.225 g/see, or at least 0.25 g/see, or at least 0.275 g/see, or at least 0.3 g/see, or at least 0.325 g/see, or at least 0.35 g/see for at least the first 2 seconds of water contact. In some embodiments, the sheet of material (per single layer of the sheet of material, or for the material as folded for the sleeve configuration (as discussed below)) has a water absorbency rate of at least 0.025 g/see, or at least 0.05 g/see, or at least 0.075 g/see, 0.1 g/see, or at least 0.125 g/see, or at least 0.15 g/see, or at least 0.175 g/see, or at least 0.2 g/see, or at least 0.225 g/see, or at least 0.25 g/see, or at least 0.275 g/see, or at least 0.3 g/see, or at least 0.325 g/see, or at least 0.35 g/see for at least the first 5 seconds of water contact. The water capacity of the sheet of material (per single layer of the sheet of material, or for the material as folded for the sleeve configuration (as discussed below)) may be determined based on a sample circular sample with a 3.375 inch diameter and a Capacity and Rate Tester device as is known in the art (see, e.g., *Paper Towel Absorptive Properties and Measurement Using Horizontal Gravimetric Device*, David Loebker and Jeffrey Sheehan, 2011 PaperCon Conference, pages 1210-1218). In some embodiments, the sheet of material (per single layer of the sheet of material, or for the material as folded for the sleeve configuration (as discussed below)) has a detached water capacity of at least 0.01 g/in$^2$, or at least 0.0175 g/in$^2$, or at least 0.02 g/in$^2$, or at least 0.0225 g/in$^2$, or at least 0.025 g/in$^2$, or at least 0.0275 g/in$^2$, or at least 0.03 g/in$^2$, or at least 0.0325 g/in$^2$, or at least 0.035 g/in$^2$, or at least 0.0375 g/in$^2$, or at least 0.04 g/in$^2$.

When arranged/configured as the cup sleeve 100, as shown in FIGS. 1 and 2, the sleeve 100 may be in a first folded (closed) position. In the first folded position the sleeve 100 may be substantially flat and thin (e.g., collapsed) with the inner cavity being substantially closed as shown in FIG. 1, as opposed to a second unfolded (open) position with the sleeve 100 defining an enlarged or open configuration (e.g., of a generally circular or conic shape) with the inner cavity being open as shown in FIG. 2. The sleeve 100 may comprise a flattened/compressed annular shape with about half of the sleeve 100 folded/compressed over the other about half of the sleeve 100 such that the two portions are stacked or overlaid (e.g., adjacent and abutting or close to each other) on each other, as shown in FIG. 2. The sleeve 100 may be arranged in the first folded position prior to (and/or after) use thereof, for example.

In the first folded position, cup sleeve 100 includes a first lateral side/side edge 120, a first corner or point 125 between the first lateral side 120 and a top side/side edge, a second lateral side/side edge 110, and a second corner or point 115 between the second lateral side 110 and the top side, as shown in FIG. 1. In the first folded position, the first and second points 115 and 125 form corners. In some such embodiments, the first point 115 may define a substantially right angle, and the second point 115 may form an acute angle, in the first folded position, as shown in FIG. 1. The top and bottom sides of the sleeve may be substantially linear and extend parallel to each other in the first folded position, as shown in FIG. 1.

It is noted that in the first folded position, the sleeve 110 may be arranged in a closed annular shape such that the inner cavity is substantially closed. None-the-less, the sleeve 110 is annular in that it forms an annular wall. It is also noted that as the sleeve 100 is pliable, it can be readily manually deformed or rearranged into the second open position, or another different closed position as discussed below.

Figure 4:
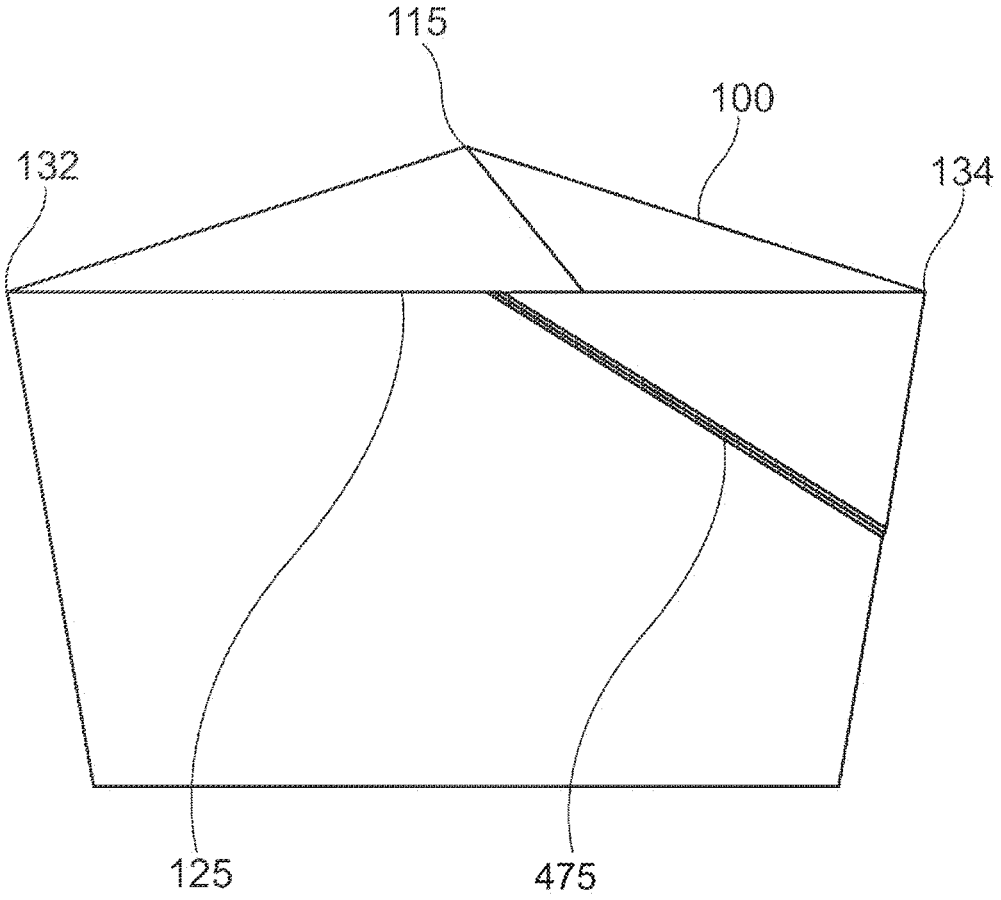
FIG. 4 illustrates a front view of the exemplary cup sleeve of FIG. 1 in a second closed configuration.
Figure 5:
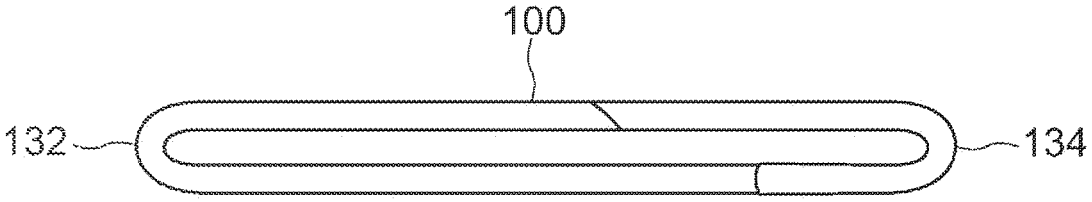
FIG. 5 illustrates a top view of the exemplary cup sleeve of FIG. 1 in the second closed configuration.
Figure 6:
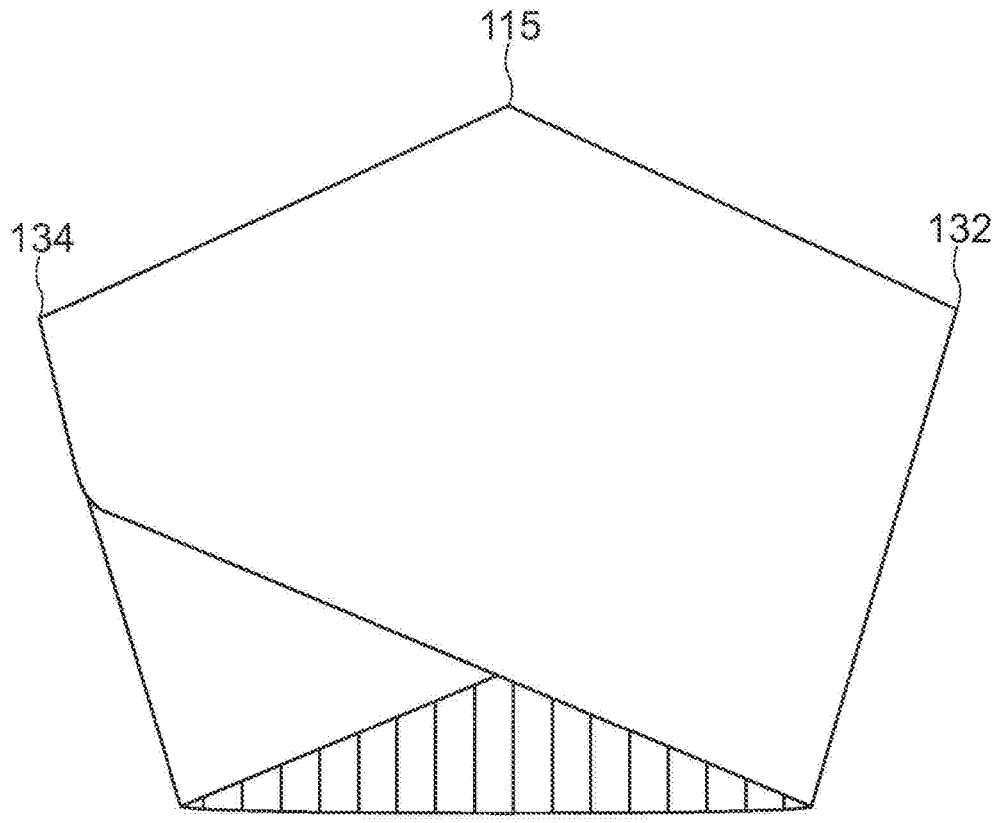
FIG. 6 illustrates a back view of the exemplary cup sleeve of FIG. 1 in the second closed configuration.

FIGS. 4-6 illustrate a third folded (closed) position/arrangement of the sleeve 100. As shown in FIGS. 4-6, the pliable sleeve 100 may be closed or folded flat such that the first and second points 125, 115 are substantially aligned and the corresponding portions of the sleeve 100 are overlapping. In the third folded position, the sleeve 100 may be substantially flat and thin (e.g., collapsed) with the inner cavity being substantially closed, as shown in FIG. 5. The sleeve 100 may comprise a flattened/compressed annular shape with about half of the sleeve 100 folded/compressed over the other about half of the sleeve 100 such that the two portions are stacked or overlaid (e.g., adjacent and abutting or close to each other) on each other, as shown in FIG. 5. The sleeve 100 may be arranged in the third folded position prior to (and/or after) use thereof, for example.

As shown in FIGS. 4 and 6, in the third folded arrangement, and with the axis X-X of the cavity/wall oriented vertically, the point 115 of the upper/top edge/side is positioned higher (i.e., above) the other portions of the sleeve 100 (e.g., the other portions of the top edge), including point 125. Also, as shown in FIG. 4, in such an arrangement and orientation, the front side portion of the sleeve 100 may include a substantially linear bottom side/edge (potentially arranged horizontally), and/or a substantially linear top side/edge (potentially arranged horizontally). As FIGS. 4 and 6, the top edge of the sleeve 100 may extend downwardly (e.g., on a straight angle or arcuately, for example) high point 115 to lateral side edges or corners 132, 134, and/or the remining portion of the top edge of the sleeve 100 may extend laterally between the lateral side edges or corners 132, 134 (and comprise the point 125). In some such embodiments, the portion of the top edge of the sleeve 100 may extend substantially horizontally laterally between the lateral side edges or corners 132, 134 in the third folded arrangement and orientation, as shown in FIG. 4. As also shown in FIG. 4, the portions of the top side and bottom side of the sleeve 100 at the front of the sleeve 100, in the third folded arrangement, may extend substantially parallel to each other. As shown in FIG. 6, the portions of the top side and bottom side of the sleeve 100 at the back of the sleeve 100, in the third folded arrangement, may extend parallel to each other.

As shown in FIG. 1, in some embodiment, an angled or slanted edge 475 may be visible at the outer side of the sleeve 100, which may extend along a portion of the sleeve 100 between (e.g., completely between) the top and bottom sides thereof. The edge 475 may comprise one edge formed by a single layer of the sheet of material forming the sleeve 100, or a plurality of edges formed by a plurality of layers of the sheet of material forming the sleeve 100. For example, as shown in the exemplary illustrative embodiment in FIG. 1, the edge 475 may comprise three edges of the sheet of material forming the sleeve 100. In some other embodiments, the edge 475 may or may not be visible at the outer side of the sleeve 100 in the first folded position.

The sleeve 100 may be transformed from the first or third folded position into the second open position, for example, by pressing on the lateral sides of the sleeve 100, or pulling/pushing the adjacent portions away from each other to expand the area/size of the inner cavity. In the second open position, the sleeve 100 may define a substantially circular cross-section (e.g., the outer and inner faces thereof may define a substantially circular cross-section, and/or the inner cavity may have a substantially circular cross-section), as shown in FIGS. 3 and 7A-7C. It is noted that in some embodiments, in the second open position, the sleeve 100 may define a top opening (to the inner cavity) with a larger size (e.g., circumference) than the bottom opening. For example, in accordance with some common cups, the outer and inner faces, and thereby the inner cavity, may define a conic shape with the top portion thereof being larger than the bottom portion thereof). In use, a cup may be inserted through the inner cavity from the top opening and then through the bottom opening. As explained further below, in the open position with the axis of the cavity oriented vertically, the top end, side or edge of the cup sleeve 100 may include or define a high point 115, a low point 125, and side portions 132, 134 extending therebetween. It is also noted that the sleeve 100 may be formed/deformed into other open positions such that the inner and outer face, and the inner cavity, take on other shapes with the inner cavity being enlarged as compared to the first folded position, such as to accommodate or engage cups of other cross-sectional shapes and/or sizes.

Figure 7A:
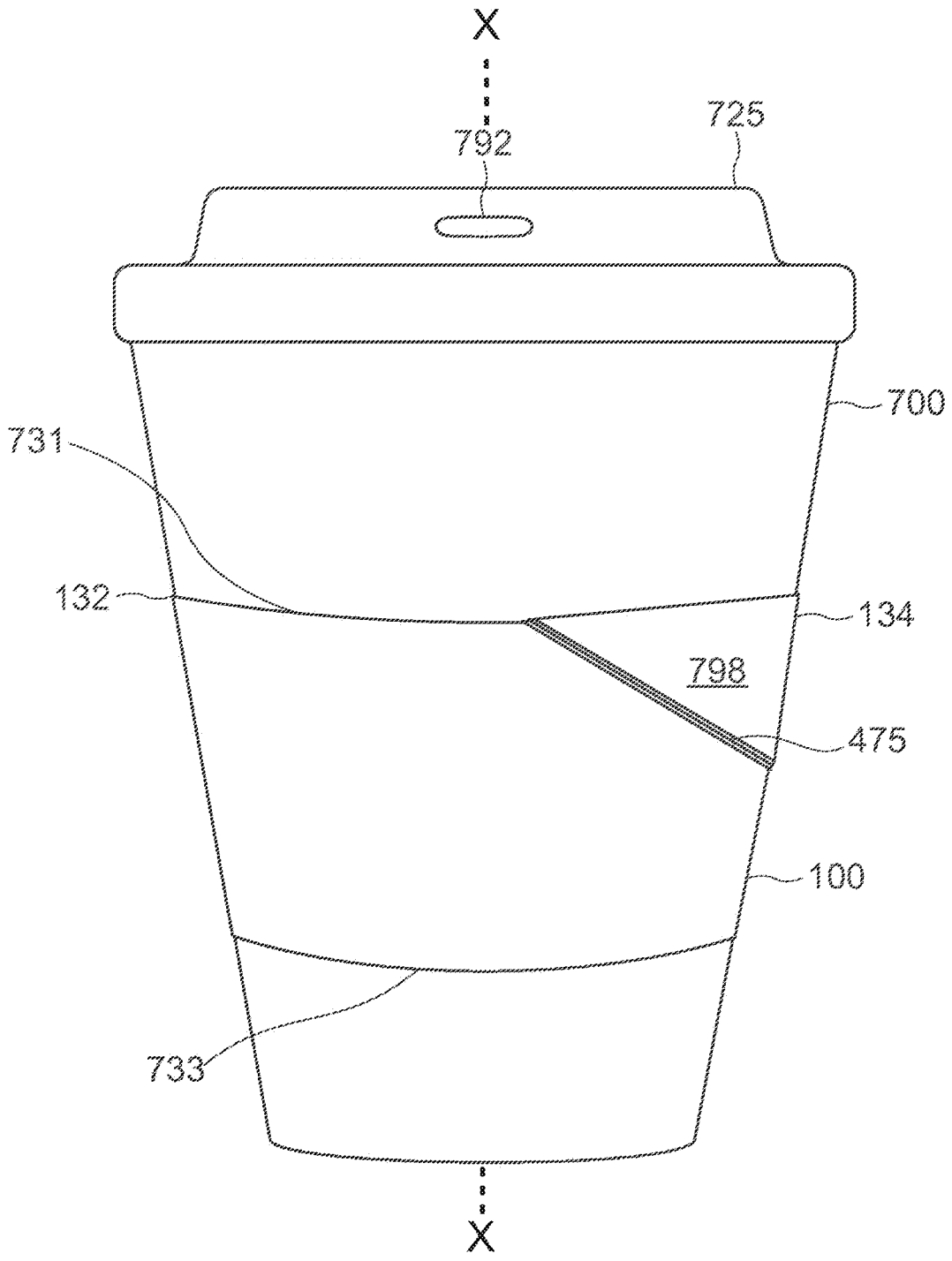
FIG. 7A illustrates a front view of the exemplary cup sleeve of FIG. 1 in the open configuration and engaged with an exemplary container in accordance with the present disclosure.
Figure 7B:
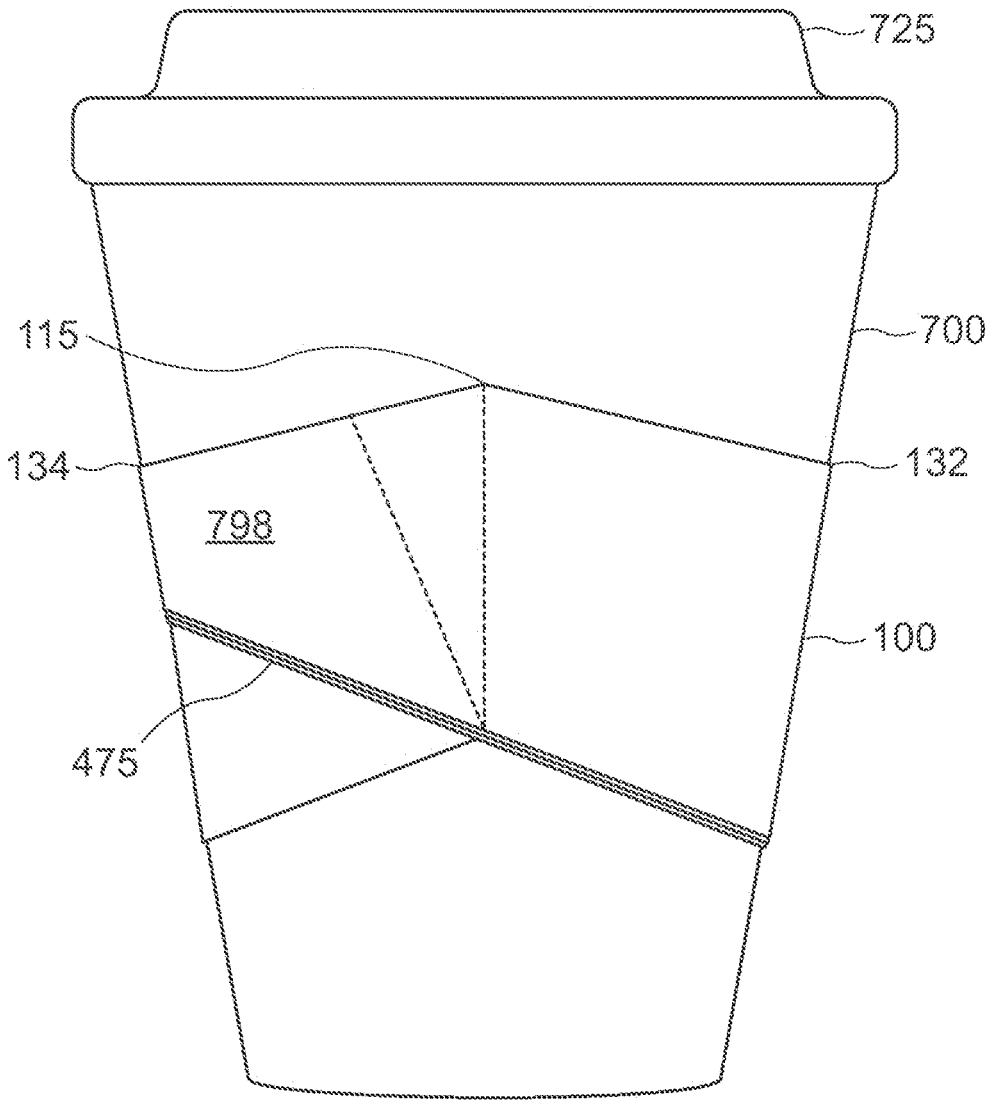
FIG. 7B illustrates a back view of the exemplary cup sleeve and exemplary container of FIG. 7A.
Figure 7C:
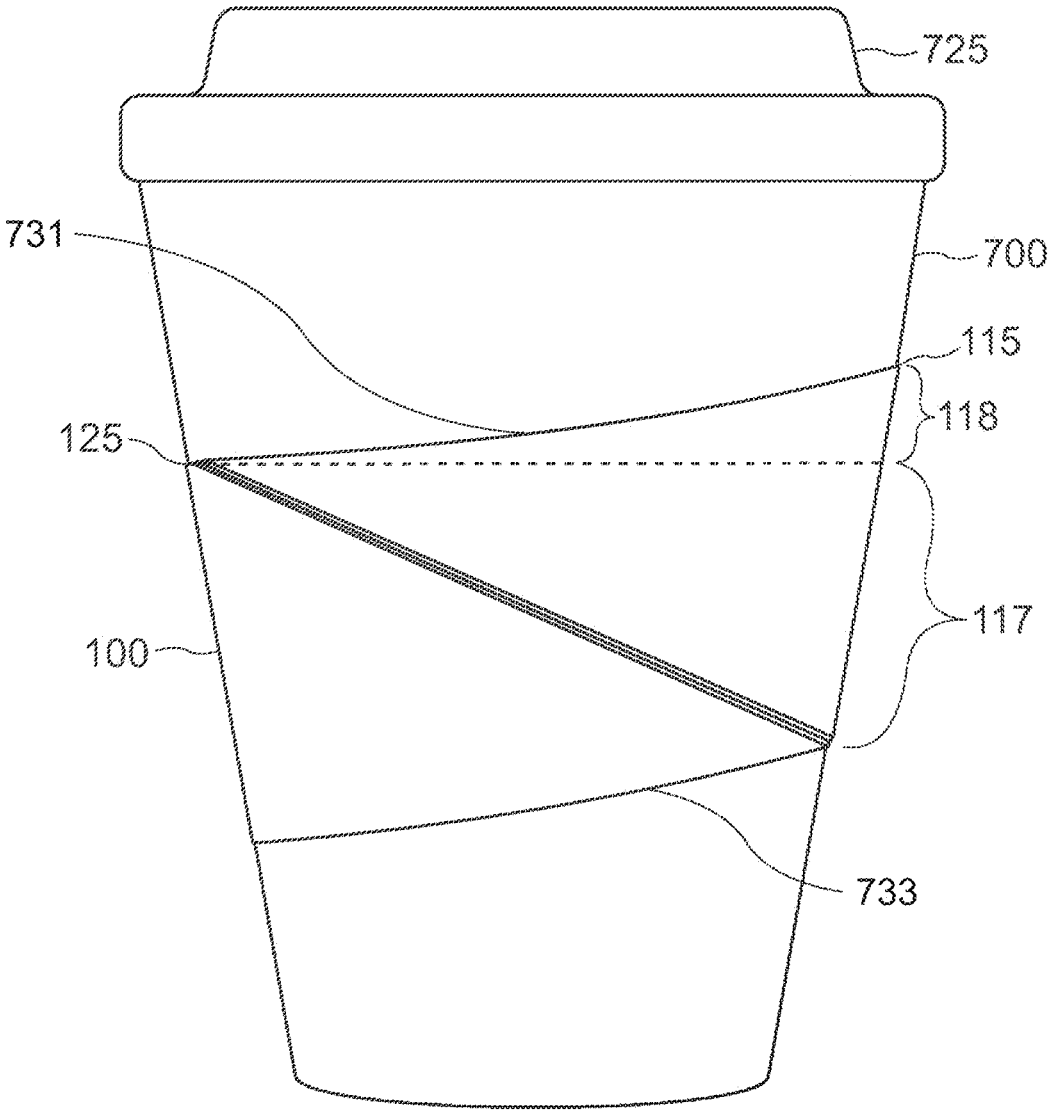
FIG. 7C illustrates a right side view of the exemplary cup sleeve and exemplary container of FIG. 7A.
Figure 8:
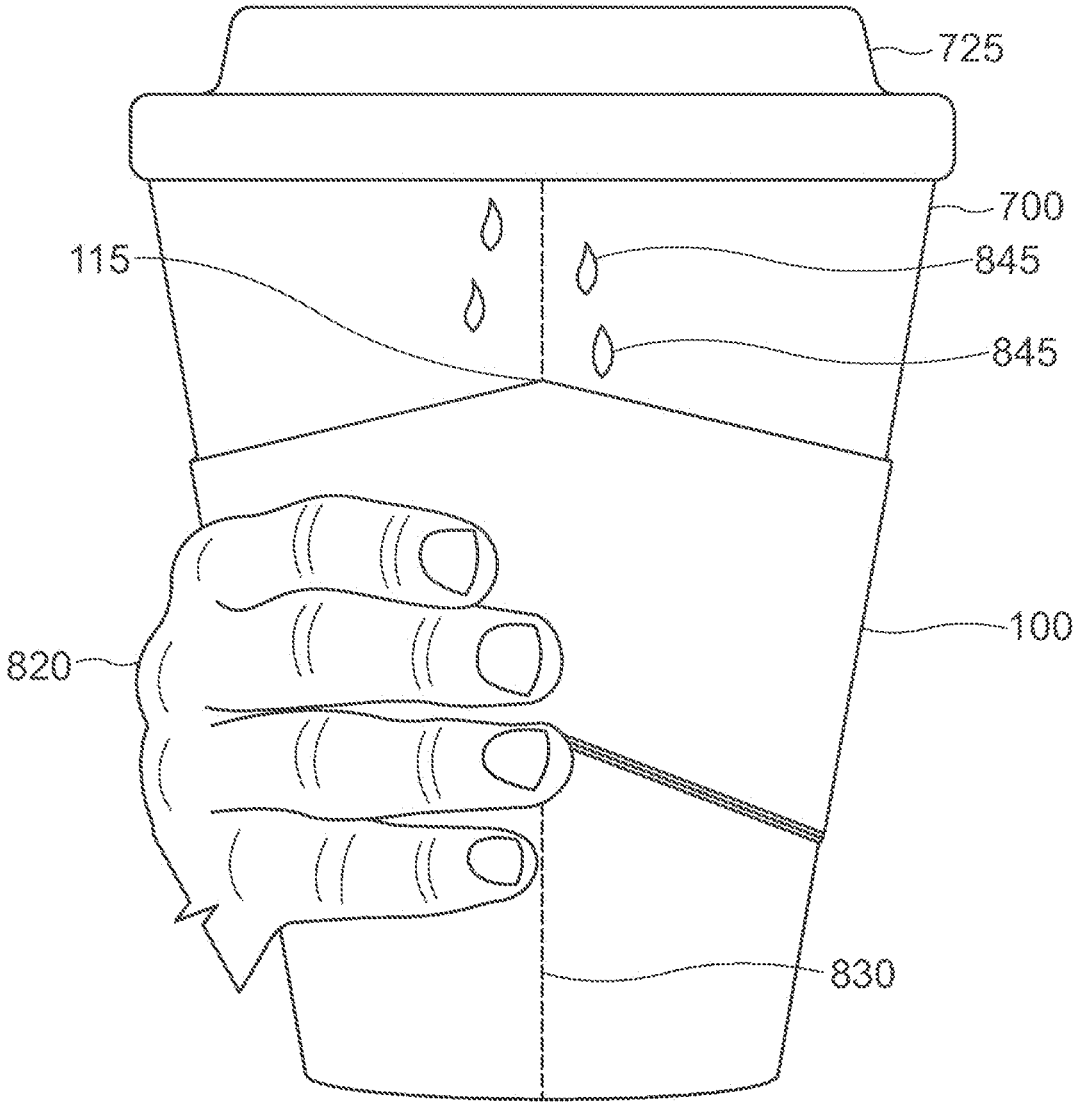
FIG. 8 illustrates a back view of the exemplary cup sleeve and exemplary container of FIG. 7A and being held by an exemplary user's hand in accordance with the present disclosure.
Figure 9:
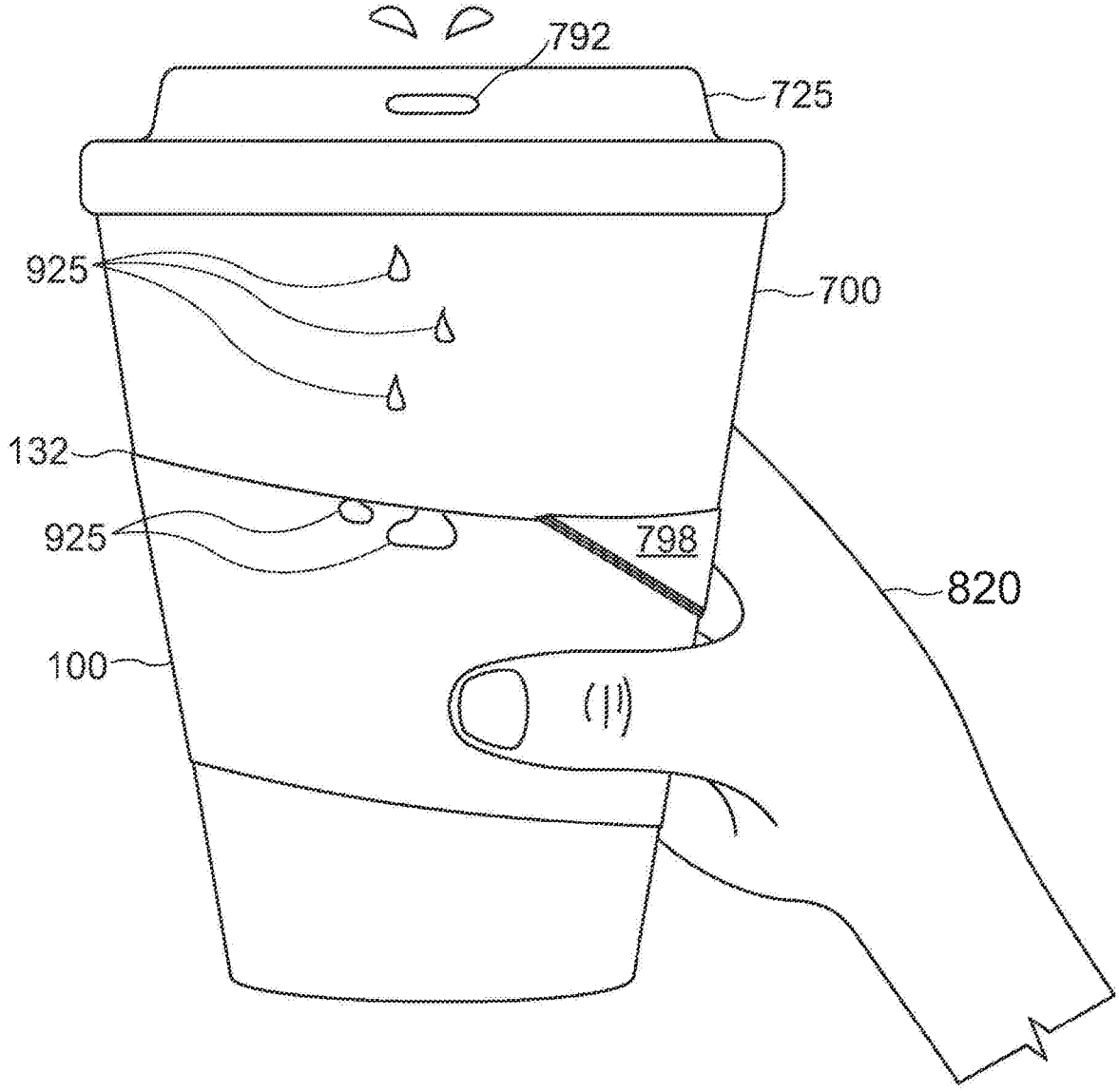
FIG. 9 illustrates a left side view of the exemplary cup sleeve, exemplary container and user's hand of FIG. 8.

The sleeve 100 may be configured to advantageously receive and engage with cups of various sizes and shapes. FIGS. 7A-7C show several views of the sleeve 100 engaged with the outer wall of an exemplary conical cup 700 about the circumference thereof. As shown in FIGS. 7A-7C, the cup 700 may have a lid 725 with a spout, drink opening or designated drinking spot 792. FIGS. 7-9 illustrate the construction and shape of the sleeve 100 when the cup sleeve is fitted around a cup.

As shown in FIGS. 7A-7C, the sleeve 100 is configured such that when engaged with a cup 700 positioned within the inner cavity, the cup sleeve 100 has a bottom/lower side/edge 733 and a top/upper side/edge 731 that extend substantially parallel to each other. Lower edge 733 and upper edge 731 are configured such that they do not extend horizontally when the axis X-X is oriented vertically (e.g., when the axis of the cup 700 is oriented vertically, such as when it rests on a horizontal surface). In one embodiment, the cup 700 has a conical frustrum shape. Cups and containers having other shapes and sizes may equally be used with the sleeve 100.

As shown in FIG. 7A, the sleeve 100 includes a portion/section/region 798 which includes more layers of the at least one sheet of material, and therefore is thicker, than other portions of the sleeve. 100 Advantageously, when the cup 700 is held by a user, the extra thickness of region 798 can provide added thermal insulative protection to a portion of the user's palm, as shown in FIG. 9.

The sleeve 100 is configured such that the top edge 731 extends upwardly as it extends from the low point 125 to the high point 115 about each side of the sleeve 100 (and cup 700) when in the second open arrangement (and potentially engaged with cup 700). The bottom edge 733 may extend substantially parallel to the top edge 731 such that that is extends upwardly from a low point on one side of the sleeve 100 (and cup 700) to a high point on an other side of the sleeve 100 (and cup 700). In some embodiments, the low point 125 to the high point 115 may be on opposing sides of the sleeve 100 (and cup 700). In some such embodiments, in the second open arrangement and with the axis X-X oriented vertically (e.g., when engaged with a cup 700 such that the axis X-X is aligned with a vertically-oriented axis of the cup 700), the sleeve 100 may comprise a first portion 117 that extends horizontally (e.g., perpendicular to the axis X-X) continuously about the circumference of the sleeve 100 and cup 700, and a second portion 118 that extends upwardly from the first portion 117 to the high point 115 that decreases in height as it extends away from the high point 115 about both sides of the sleeve 100 and cup 700, as shown in FIG. 7C. Similarly, in such a configuration and orientation, the sleeve 100 may include a third portion that extends downwardly from the first portion 117 to a low point (e.g., at an opposing side of the sleeve 100 as the high point 115) that decreases in height as it extends away from the low point about both sides of the sleeve 100 and cup 700, as shown in FIG. 7C.

The sleeve 100, as a whole, may thereby extend upwardly as it extends from one side of the sleeve 100 (and cup 700) to the other side of the sleeve 100 (and cup 700). As shown in FIGS. 8 and 9, the angled or non-horizontal orientation or shape of the sleeve 100 may be advantageous as the "low" portion of the sleeve 100 may be engaged with a "low" portion of user's hand 820, and the "high" portion of the sleeve 100 may be engaged with a "high" portion of user's hand 820 that engage a cup 700 in the natural grip of a user's hand when holding a cup 700, as shown in FIGS. 8 and 9.

It has been observed that many people hold a cup 700 in such a way that portions of the palm and/or thumb of the user's hand 820 contact the cup 700 at a location on the cup 700 that is lower than the point(s) where the other four fingers contact the cup 700, as shown in FIGS. 8 and 9. The non-horizontal shape or profile of the sleeve 100 in the second open configuration, such as when engaged with a cup 700, thereby provides advantageous thermal and moisture insulation protection for the user's hand 820 that results in a comfortable and natural hand placement in the cup 700. For example, as shown in FIGS. 8 and 9, when the cup 700 with the sleeve 100 is held by a user's hand 820 utilizing a natural grip of the user's hand, the "low" portion of the sleeve 100 may be engaged with the thumb and adjacent portion of the palm of the user 932, and the "high" portion of the sleeve 100 may be engaged with the user's second, third, fourth and/or fifth fingers and adjacent portion of the palm of the user 932. In this way, the sleeve 100 may be configured to extend over the cup 700 along a profile or pathway that corresponds to the profile or shape of the hand 820 of a user that would engage the cup 700 in a natural or typical grip of the cup 700. The sleeve 100 may thereby be effective in providing thermal and moisture insulation between the portions of the user's hand 820 that would normally contact the cup 700 by being positioned between such portion of the user's hand 820 and the cup 700 (and thereby engage with the user's hand 820 and be positioned between the user's hand 820 and the cup 700). It is noted that in the natural grip of the cup 700 by a user's hand 820, the drinking spout or spot is typically substantially aligned with the thumb of the user, as shown in FIG. 9.

FIG. 8 illustrates the cup sleeve 100 fitted onto a cup 700 and held by a user's hand 820. As shown in FIG. 8, in some embodiments, the cup 700 may include a seam 830, which may tend to leak liquid/fluid 845 from inside the cup 700 to outside the cup 700. For example, the seam 830 may cause a gap or other opening for liquid 845 to pass therethrough or between the lid 725 and the top edge/side of the cup 700, as shown in FIG. 8. As shown in FIG. 8, such leaked liquid 845 would tend to move downwardly (via gravity) along the outer surface of the cup 700 toward sleeve 100 and the user's hand 820, and upon contact with the sleeve 100, be absorbed by the sleeve 100. Advantageously, the sleeve 100 extends above the user's hand 820 (e.g., the portion including point 115), as shown in FIG. 8, and consequently the liquid 845 would become absorbed by the sleeve 100 before it reaches the user's hand 820 and is absorbed by a portion of the sleeve 100 that is spaced from the user's hand 820. Further, as shown in FIG. 9, liquid 925 that travels outside of the cup 700 via the spout or drinking spot 792 would tend to move downwardly (via gravity) along the outer surface of the cup 700 toward sleeve 100 and the user's hand 820, and upon contact with the sleeve 100, be absorbed by the sleeve 100. Advantageously, the sleeve 100 extends above the thumb of the user's thumb, as shown in FIG. 9, and consequently the liquid 925 would become absorbed by the sleeve 100 before it reaches the user's thumb and is absorbed by a portion of the sleeve 100 that is spaced from the user's thumb.

In some embodiments, the sleeve 100 thereby advantageously provides not only natural finger placement for comfort and better grip, but has a portion with triple the amount of layers of the sheet of material in the section (for example, section 798 shown in FIG. 9) that is in direct contact with the palm of the user's hand 820. In some embodiments, the sleeve 100 is configured via folding of the sheet of material into the annular shape. In some embodiments, the portion 798 with at least three layers of the material, and/or three times the amount of layers of the material as other portions of the sleeve 100, is formed via a first end portion of the sheet of material being folded over the top or bottom edge of a second end portion of the sheet of material. In this way, the first end portion may extend along/over a front/outer face/side of the second end portion, over the top or bottom edge thereof, and along/over a back/inner face/side of the second end portion that opposes the front/outer face/side thereof. The second end portion may thereby be positioned between a back portion and a front portion of first end portion, and thereby include three overlapping layers of the sheet of material. In some embodiments, the front and back portions of first end portion may be triangular shaped.

In some embodiments, the second end portion may be retained within/between the back portion and the front portion of first end portion via friction, such that the second end portion can be freely (e.g., manually) pulled out/removed from between the front and back portions of first end portion to disassemble the annular configuration of the sleeve 100. In some such embodiments, the overlapping first and second end portions may be retained together, and the sleeve 100 thereby retained in the annular configuration, via only friction fit of the second end portion within/between the front and back portions of first end portion. In some other embodiments, the first and second end portions may be coupled together (fixedly or removable) via an adhesive (e.g., a glue) and/or a mechanical fastening mechanism (e.g., a staple, pin or the like). It is noted that pressure exerted from within the inner/interior cavity acting outwardly (i.e., away from the axis X-X) would act on the back portion of the first end portion, and thereby act to further engage/clamp the second end portion within/between the front and back portions of first end portion (i.e., increase the friction therebetween). Engagement of the sleeve 100 on a cup 700 via sliding of the sleeve 100 up a conical-shaped cup 700 would thereby not tend to force the second end portion out from within/between the front and back portions of first end portion, and thereby the annular shape of the sleeve 100 would be retained and engage the outer sides/surfaces of the cup 700.

FIGS. 10A-10B depicts an exemplary method of manufacturing a liquid absorbent and/or thermally insulative cup/container sleeve, such as a sleeve 100 as disclosed above with respect to FIGS. 1-9. The method of FIGS. 10A-10B are herein discussed below with reference to FIGS. 11A-11L.

At step 1010, at least one sheet material is prepared. In one embodiment, the sheet of material is relatively-highly liquid absorbent material, such as a paper towel, napkin or the like. In one exemplary embodiments, the sheet of material 1000 is a paper sheet of material formed from a flexible, soft paper pulp. In one embodiment, the sheet material includes at least one textured surface or face. For example, in some such embodiments, the sheet of material 1000 may comprise a sheet of paper towel with raised grooves, which may provide enhanced gripability and thermal protection as compared to a smooth face for example. The sheet of material 1000 may be prepared in any suitable manner. For example, the sheet of material 1000 may be placed on a surface. Other methods of preparation may be used.

Figure 11A:
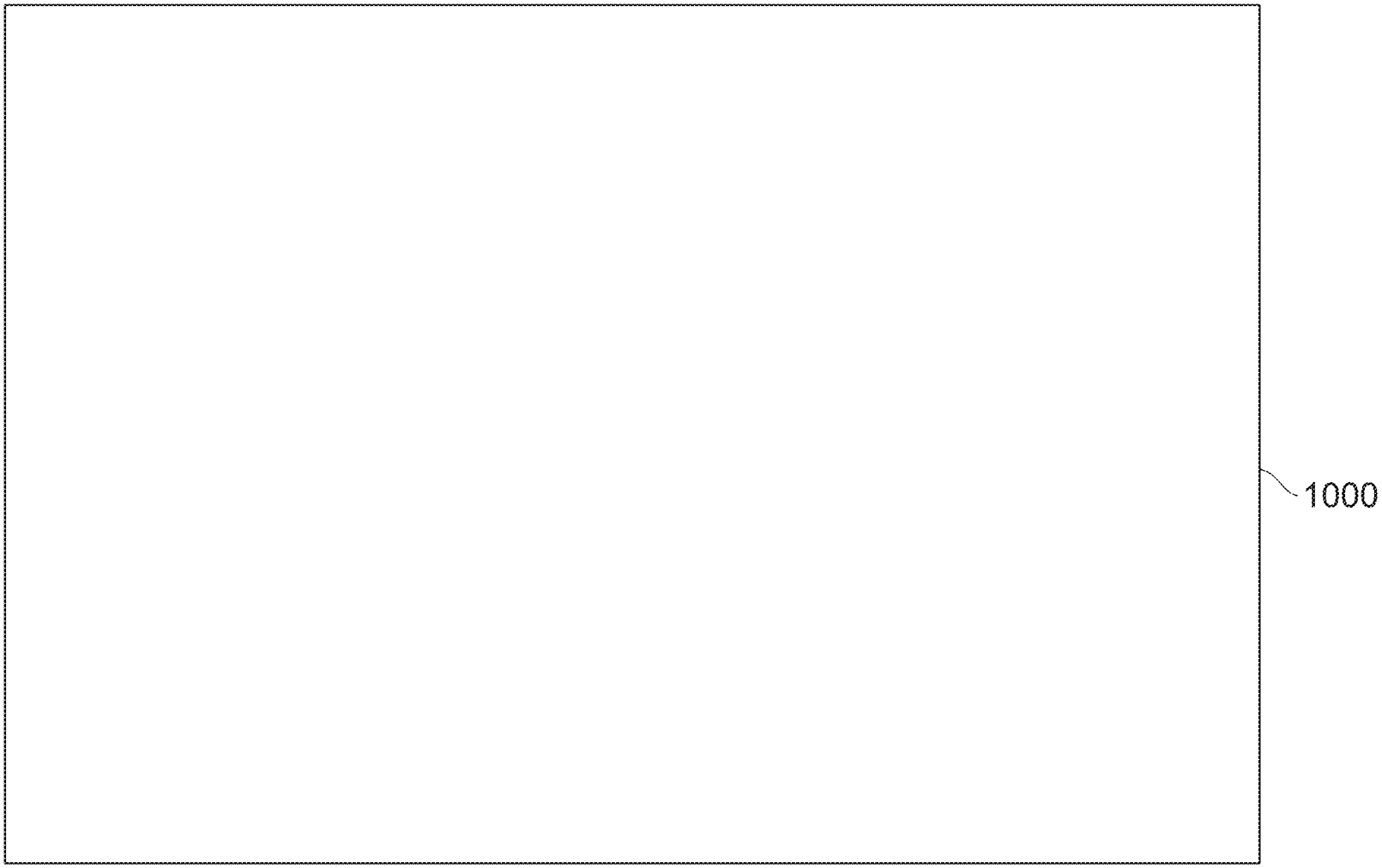
FIGS. 11A-11L illustrate the exemplary method of manufacturing the container sleeve of FIG. 10 via sheet of absorbent material.

As shown in FIG. 11A, the sheet of material 1000 may be a thin, pliable sheet of material defining a length between two opposing lateral sides/side edges, and a width extending between top and bottom sides/edges. The top and bottom sides extend between the lateral sides. In some embodiments, the lateral sides/edges and/or the top and bottom sides/edges, may be linear/straight. In some embodiments, the lateral sides/edges may be shorter than the top and bottom sides/edges. In some embodiments, the lateral sides/edges and the top and bottom sides/edges may be oriented perpendicular with respect to each other, as shown in FIG. 11A. In some embodiments, the sheet of material 1000 may thereby be rectangular or square. The sheet of material 1000 also comprises or defines a front face or side, and a back face or side, each comprising an area defined by the lateral, top and bottom sides.

In one embodiment, the sheet of material 1000 defines a total length between about 12 and about 14 inches, and/or a total width between 8 and 11 inches. In one such embodiment, the sheet of material 1000 may define a total length of about 13 inches, and/or a total width of about 10 inches. However, in other embodiments the sheet of material 1000 may define other dimensions and/or shapes.

Figure 10:
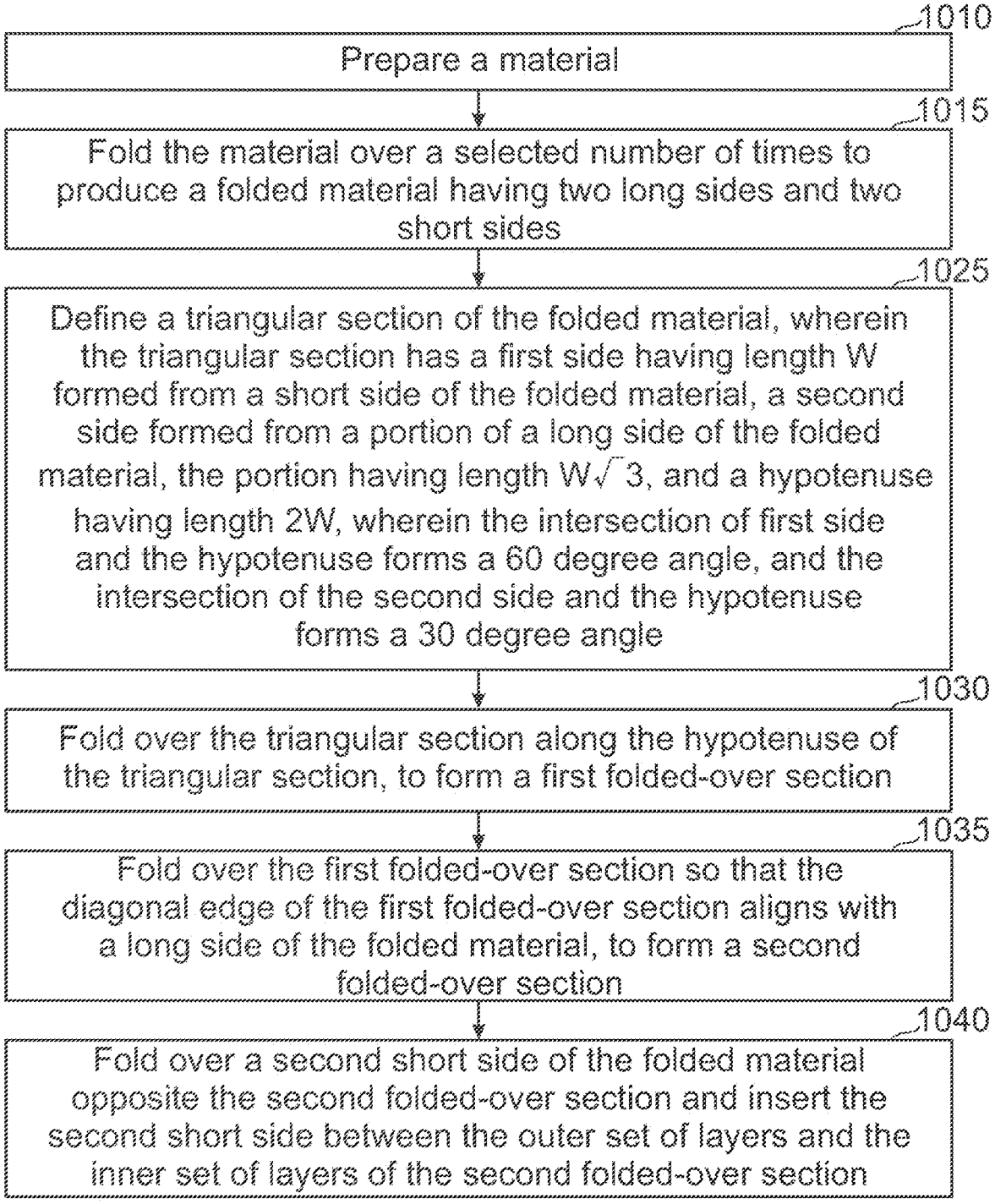
FIG. 10 is a flow chart illustrating an exemplary method of manufacturing a container sleeve in accordance with the present disclosure.

In some optional embodiments, at step 1015 of FIG. 10, and shown in FIGS. 11B-11E, the single sheet of material comprised of a single layer may be folded over a selected number of times to produce a folded sheet material. In some embodiments, after (and/or prior to) the folding 1015, the lateral sides of the sheet of material 1000 may be shorter than the top and bottom sides of the sheet of material 1000. Further, the folding 1015 may create multiple overlapping layers of the material such that sheet of material 1000 comprises at least twice the amount of overlapping layers as the un- or pre-folded sheet of material 1000. The folding of the sheet of material 1000 is described herein below with respect to a sheet of material 1000 initially comprising a single layer. However, such an initial sheet of material 1000 may comprise multiple layers, and thus the description of folding the sheet of material 1000 to create multiple overlapping layers may be adjusted respectively according to the number of layers of the initial sheet of material 1000.

Figure 11B:
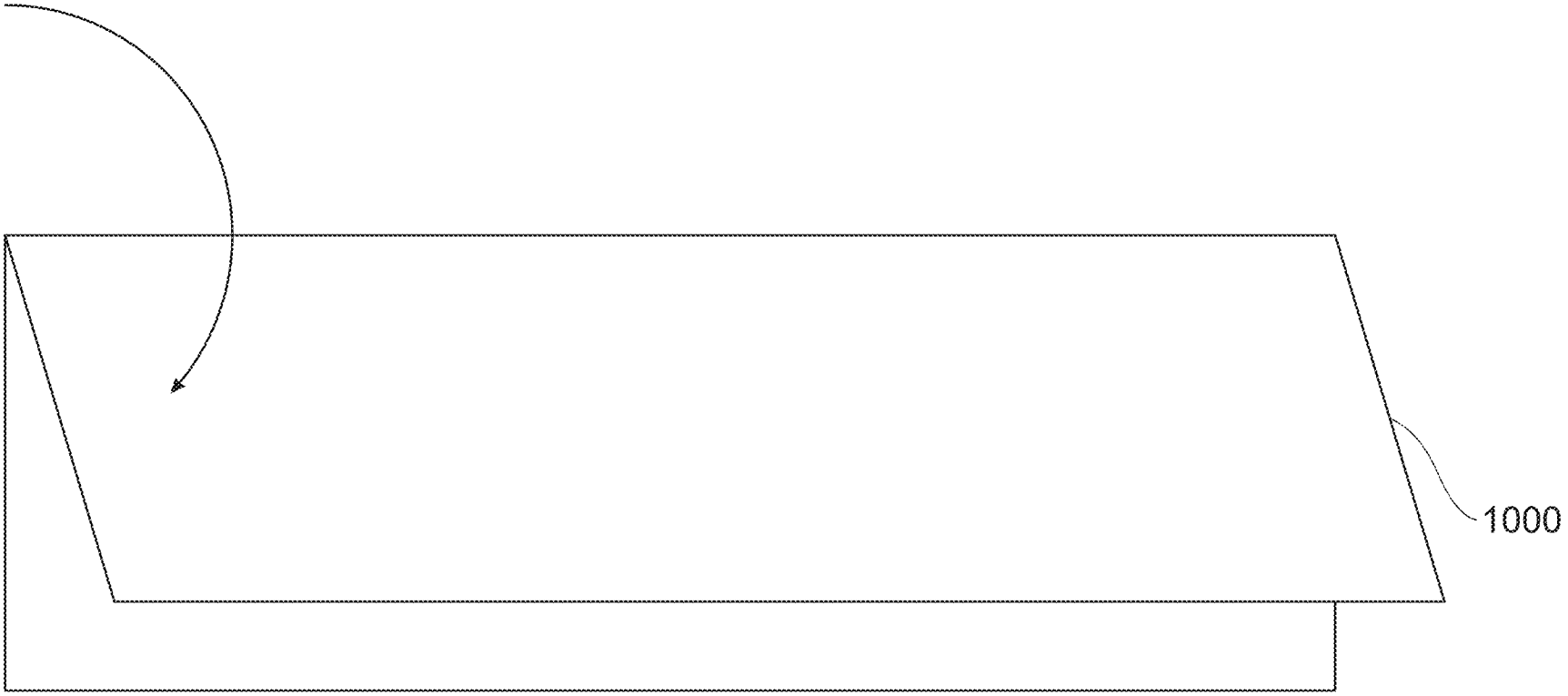
Figure 11C:
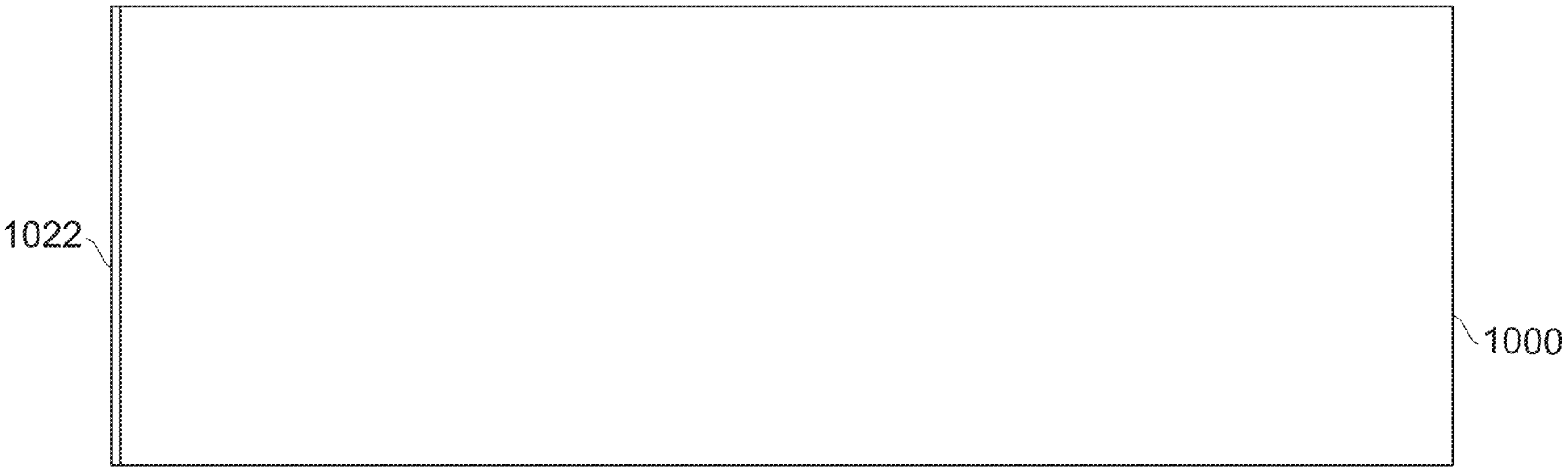
Figure 11D:
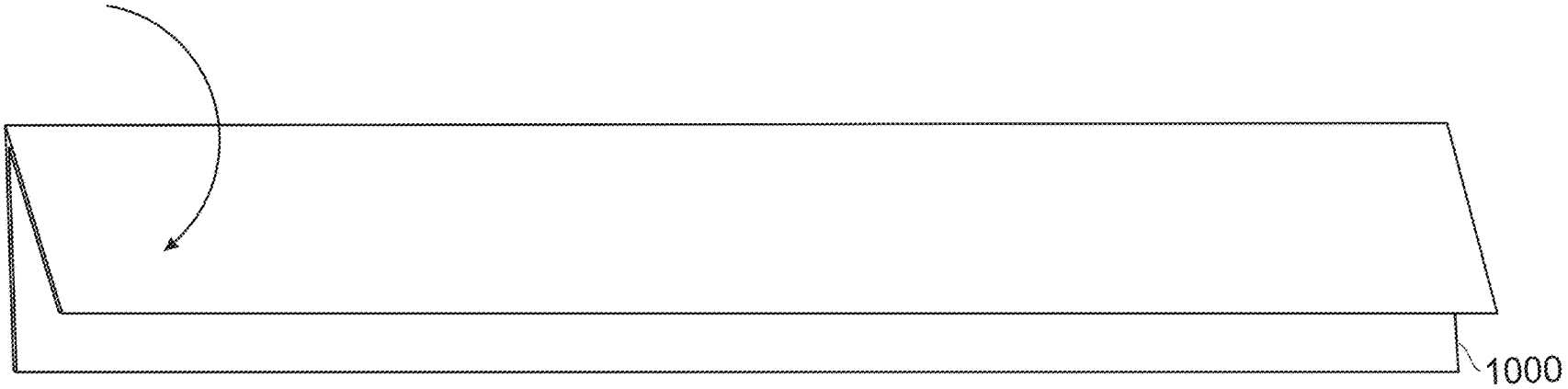
Figure 11E:
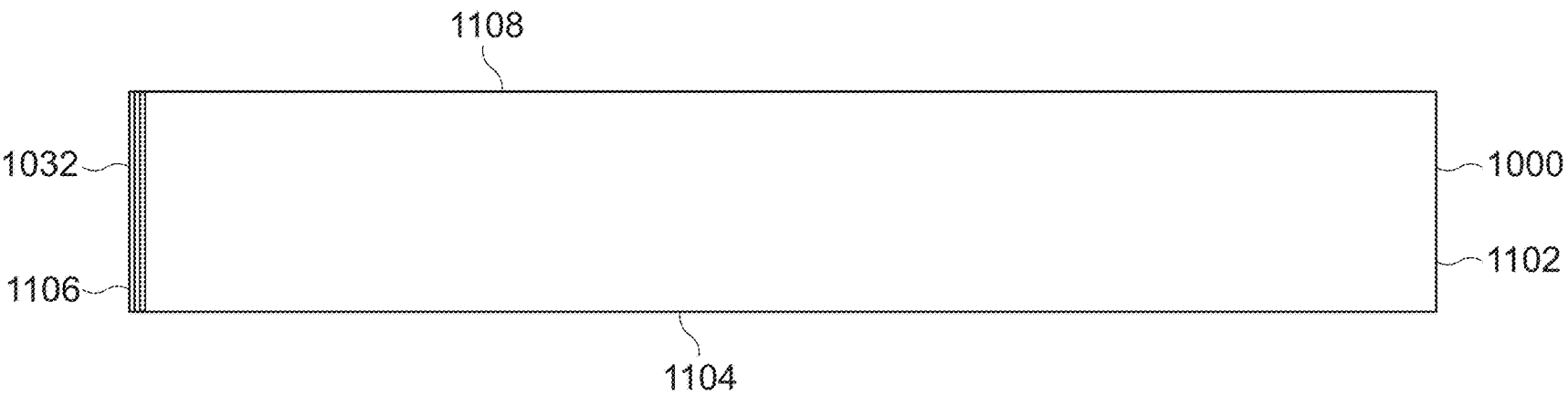

In an illustrative example, the sheet of material 1000 may initially be folded, such as in half, as shown in FIGS. 11B and 11C to produce a sheet of material 1000 with two overlapping layers of the material, as shown in by the edge 1022 in FIG. 11C. The sheet of material 1000 may thereby have at least two layers and a thickness equal to twice the thickness of the original sheet (referred to as two-ply). As shown in FIGS. 11D and 11E, in some embodiments, the sheet of material 1000 may be folded again, such as in half, to produce a sheet of material 1000 with four overlapping layers of the material, as shown in by the edge 1032 in FIG. 11E. The sheet of material 1000 may thereby have at least four layers and a thickness equal to four times the thickness of the original sheet (referred to as four-ply).

In other embodiments, the sheet of material 1000 may be folded a different number of times and may be folded using a different method. A sheet material may be folded a selected number of times to produce a folded sheet of material having more or fewer than four layers of material. For example, a sheet of material may be folded to produce a folded sheet of material having three layers of the material, and a thickness equal to three times the thickness of the original sheet of material (referred to as three-ply).

As shown in FIG. 11E, after the folding 1025 (and/or prior to the folding 1015), the sheet of material 1000 may comprise two lateral sides 1102, 1106, a top side 1108 extending between the top ends of the lateral sides 1102, 1106, and a bottom side 1104 extending between the bottom ends of the lateral sides 1102, 1106. The total length of each of the lateral sides 1102, 1106 may be less/shorter (e.g., less than half) the total length of each of the top and bottom sides 1108, 1104. In some embodiments, the sheet of material may be rectangular shaped, with the lateral sides 1102, 1106 extending parallel to each other, the top and bottom sides 1108, 1104 extending parallel to each other, and the lateral sides 1102, 1106 and the top and bottom sides 1108, 1104 being oriented perpendicular to each other, as shown in FIG. 11E.

Figure 11F:
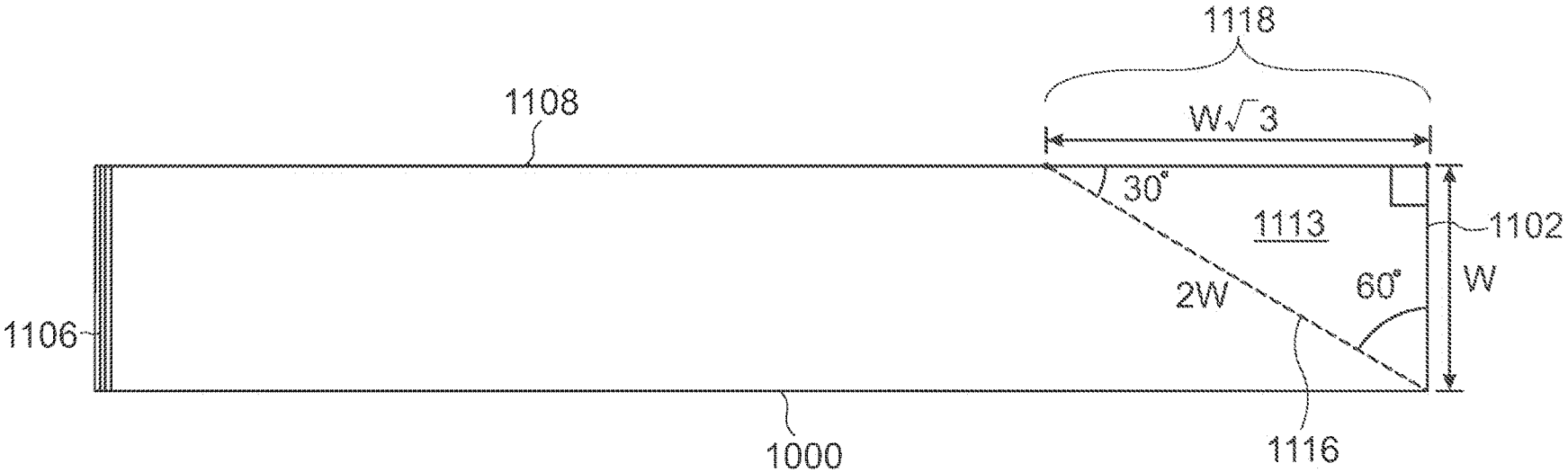

At step 1025 in FIG. 10, the method of manufacturing the sleeve 100 may comprise defining a triangular section/portion 1113 of a first lateral end portion of the sheet of material 1000 that extends from a first lateral side 1102, as shown in FIG. 11F. As shown in FIG. 11F, the triangular section may have a first side 1102 of a length W formed of at least a portion of the lateral side 1102 of the sheet of material 1000, a second side 1118 formed from a portion of a top side 1108 of the sheet of material 1000 having length WV3, and a hypotenuse fold line 1116 having length 2W. In some the intersection of the first side 1102 and hypotenuse fold line 1116 of the triangular section 1113 forms an angle of about 60 degrees, and the intersection of the second side 1118 and the hypotenuse fold line 1116 of the triangular section 1113 forms an angle of about 30 degrees. The angles described herein are examples and are not meant in a limiting sense, as other angles may be utilized.

Figure 11G:
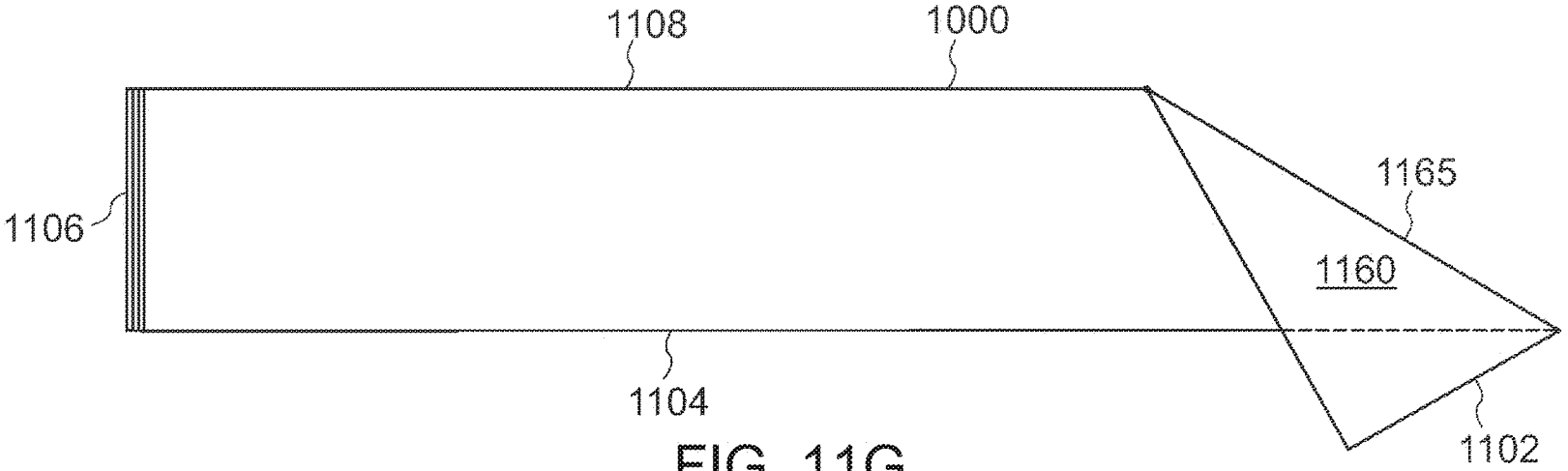

At step 1030 in FIG. 10, the defined triangular section 1113 may be folded over along the hypotenuse fold line 116 toward/onto/over the front face of the sheet of material 1000, to form a first folded-over portion/section 1160, as shown in FIG. 11G. As shown in FIG. 11G, the triangular section 1113 is thereby folded over along the fold line 1116 to form first folded-over portion 1160 comprising the triangular section 1113 overlapping an adjacent portion of the first end portion of the sheet of material 1000. The first folded-over portion 1160 may have a first side edge 1165 (congruent with hypotenuse 1116) formed by the fold line 1116, which forms a diagonal edge of the sheet of material 1000, and a second edge 1102 comprising the first lateral side of the sheet of material 1000. In some embodiments, as shown in FIG. 11G, the diagonal edge 1165 intersects/extends from the corner/junction between the bottom side 1104 (or top side 1108) and the first lateral side 1102 of the sheet of material 1000, and extends between the top side 1108 (or bottom side 1104) and the end/corner of the bottom side 1104 (or top side 1108).

Figure 11H:
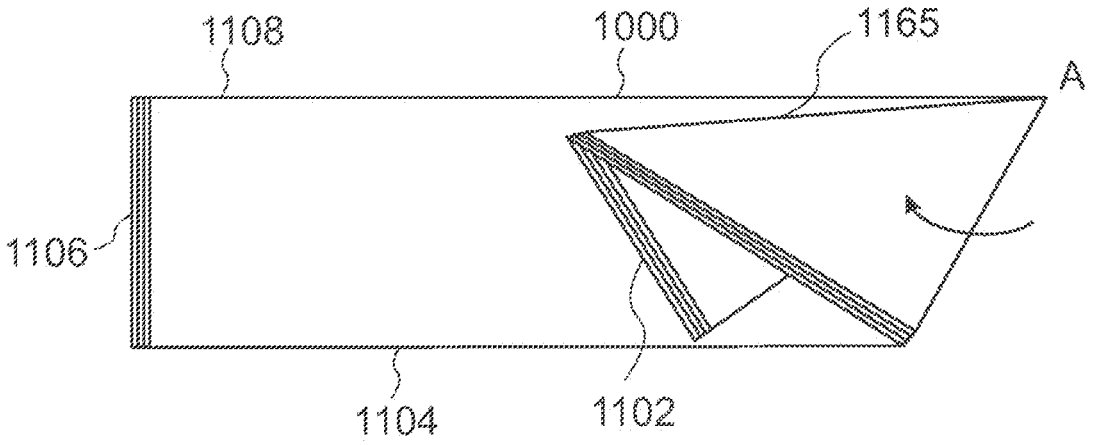
Figure 11I:
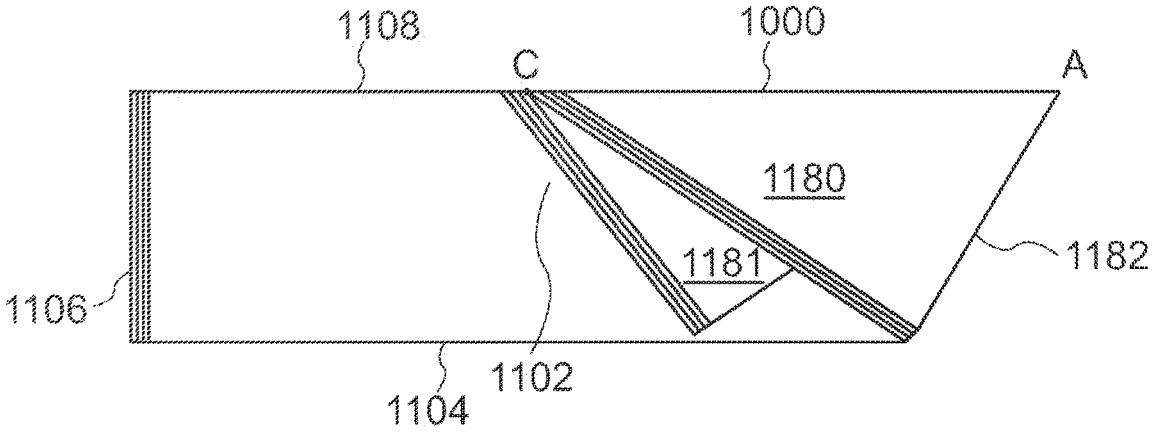

At step 1035 in FIG. 10, the first folded-over portion 1160 may be folded toward/onto/over the front face of a medial portion of the sheet of material 1000 extending laterally from the first end portion (toward the second lateral end 1106) to form a second folded-over portion 1180 as shown in FIGS. 11H and 11I. The folded-over portion 1160 may be folded over the front face of the medial portion laterally toward the second lateral end 1106 of the sheet of material 1000, as shown in FIG. 11H. As shown in FIG. 11I, the folded-over portion 1160 may be folded over the front face of the medial portion such that the diagonal edge 1165 is substantially aligned with the top edge 1108 of the medial portion (i.e., extends parallel to, and overlaps with, the top edge 1108 of the medial portion). In some embodiments, the first folded-over portion 1160 may be folded over the front face of the medial portion via a fold line that extends from the top side 1108 at a point or vertex A that is at, or substantially near but laterally spaced toward the second lateral side 1106, the intersection of the second side 1118 of the first folded-over portion 1160 and the top edge 1108. In some embodiments, the fold line may extend between the top and bottom sides 1108, 1104 such that the fold line forms an acute angle between the fold line and the top side 1108 at point A (and an obtuse angle between the fold line and the bottom side 1104), as shown in FIG. 11I. In the second folded arrangement, the vertex C between the first side edge 116 and the second edge 1102 of the triangular section 1113 may thereby be positioned on/aligned with the top edge 1108 of the medial portion of the sheet of material 1000 on the front face thereof, as shown in FIG. 11I.

As also shown in FIG. 11I, the second folded-over section 1180 may thereby comprise a first inner portion 1181 and a second outer portion 1182. The first inner portion 1181 includes at least one layer of the sheet of material 1000, and the second outer portion 1182 includes at least one layer of the sheet of material 1000. The number of layers of the first inner and second outer portions 1181, 1182 of the second folded-over section 1180 depends on the initial number of layers of the sheet of material 1000. For example, if the sheet of material 1000 includes four set of layers as shown in FIG. 11G (which may be formed via folding, as disclosed), the first inner portion 1181 and the second outer portion 1182 would each include four layers of the material. In other embodiments, the inner set of layers 1181 and the outer set of layers 1182 may include more or fewer than four layers of material.

Figure 11J:
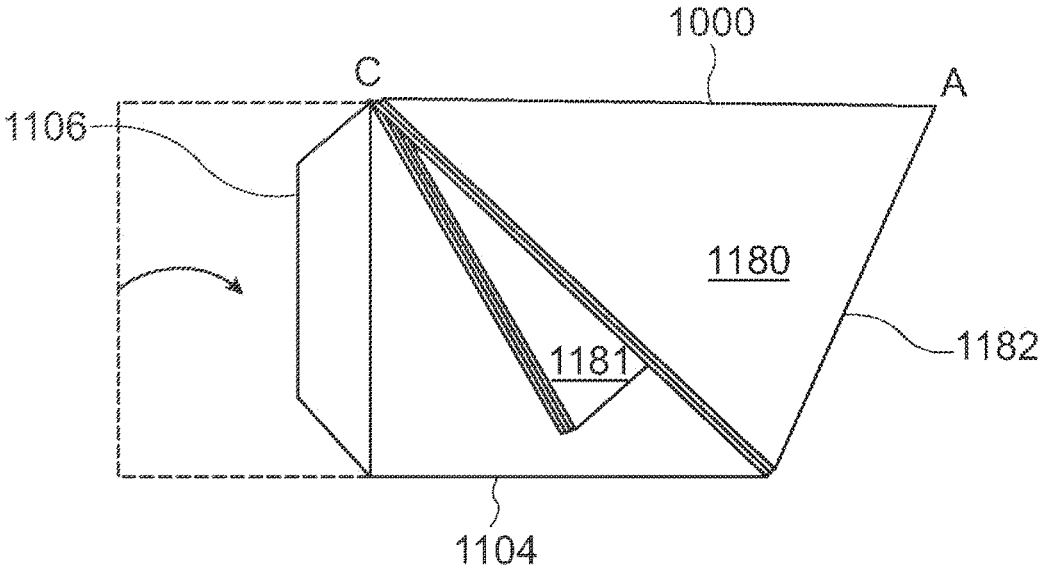
Figure 11K:
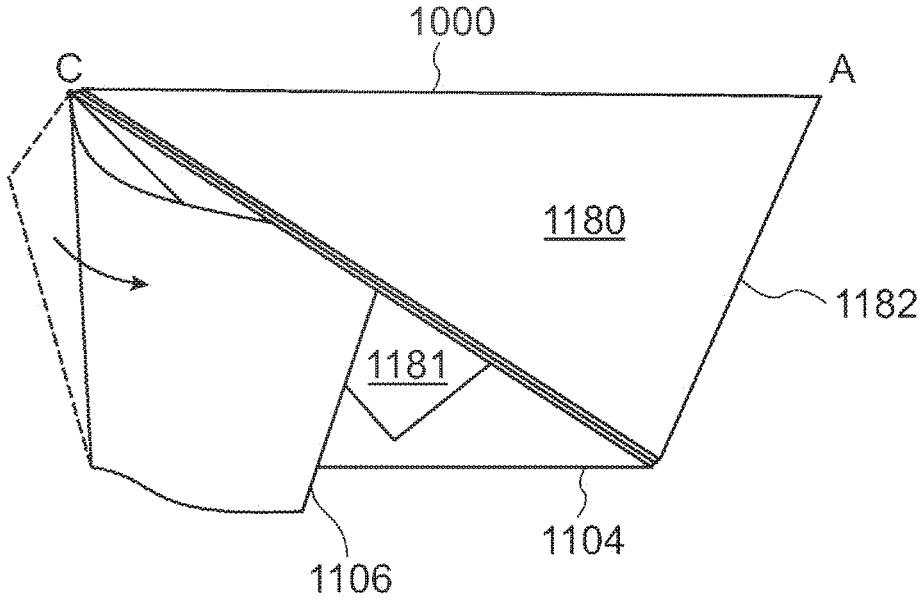
Figure 11L:
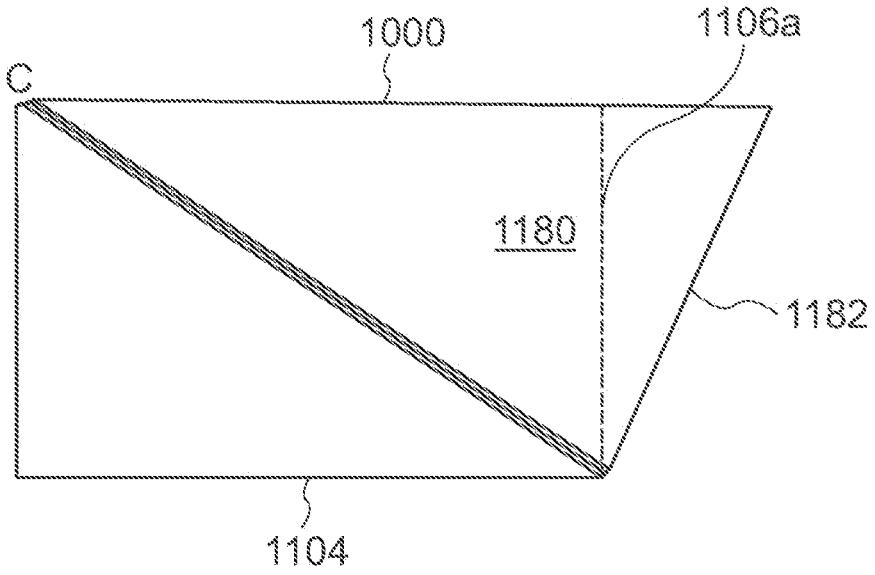

At step 1040 in FIG. 10, a second lateral end portion of the sheet of material 1000 extending laterally toward the second folded-over section 1180 from the second lateral end 1106 may be folded over the front face of the medial portion of the sheet of material 1000, and inserted between the first inner and second outer portions 1181, 1182 of the second folded-over section 1180 as shown in FIG. 11J-11L. In some embodiments, the second lateral end portion may be folded over the front face of the medial portion via a fold line that extends from at, or substantially near but laterally spaced toward the second lateral side 1106, the vertex C at the top side 1108, as shown in FIG. 11J. The second folded-over section 1180 may thereby be folded over the top edge 1108 (or bottom side 1104) of the second lateral end portion of the sheet of material 1000 (and thereby form a portion with three layers of the sheet of material 1000). In some embodiments, the fold line may extend between the top and bottom sides 1108, 1104 at a right angle, or such that the fold line forms an acute angle between the fold line and the top side 1108 of the second lateral end portion, as shown in FIG. 11J.

FIG. 11L illustrates the sheet of material 1000 after the second lateral end portion is inserted between the between the first inner and second outer portions 1181, 1182 of the second folded-over section 1180 to form an annular sleeve, such as the annular sleeve 100 of FIGS. 1-9 as described above. It is noted that the dotted lines 1106*a* illustrate the outline of the second lateral end 1106 of the sheet of material 1000, and thereby the lateral end of the second lateral end portion. As shown in FIG. 11L, after the second lateral end portion is inserted between the between the first inner and second outer portions 1181, 1182 of the second folded-over section 1180, the sleeve 100 is manufactured and ready to utilize with a cup. Further, it is noted that, as described above, an adhesive or mechanical fastener may not be utilized to form the sleeve 100 from the sheet of material 1000.

It is noted that the above method of manufacturing the cup sleeve 100 may be formed using the same or similar method steps but mirrored across the lateral direction and/or width/height direction. For example, a sleeve 100 may be formed using a mirror image of the steps described herein starting from second lateral side portion and/or determining/folding the triangular section 1113 with the second side 1118 formed from a portion of the bottom side 1104 of the sheet of material 1000. In other embodiments, other methods of folding material to form a cup sleeve similar to that described herein may be used.

Advantageously, the inventive sleeve 100 is pre-assembled as a cup sleeve but can be easily unfolded and used as a napkin, paper towel or the like. This feature allows the sleeve 100 to be used to clean spills or to be used as a coaster to soak up condensation from iced drinks. This feature offers advantages relating to convenience and ease-of-use as well as environmental benefits.

Advantageously, the sleeve 100 comprises an increased thickness under the user's open palm, providing improved insulation properties. For example, referring to FIGS. 11I-11L, a substantial portion of triangular section 1180 in the illustrative cup sleeve has 12 layers (twelve-ply), including the four outer layers of portion 1180, the four layers associated with the second lateral end portion, and the four inner layers of portion 1181. In other embodiments, portions of section 1180 may have a different thickness and/or a different number of layers of material.

The sleeve offers additional benefits. Advantageously, as noted above, in some embodiments, the sleeve does not use glue or any other adhesive. This includes no use of tabs, clips, elastic bands, snaps, staples or any other method of securing. Advantageously, the sleeve provides a self-locking feature. Because a second lateral end portion of the sheet of pliable material is sandwiched between the first inner and second outer portions 1181, 1182 of the second folded-over section 1180, when the cup is placed snugly around a cup, the second lateral end portion is compressed/squeezed between the first inner and second outer portions 1181, 1182, locking the lateral end portions of the sheet of material together in the annular arrangement/shape. For example, tension strength increases as the sleeve is slid up a tapered container preventing the two ends from coming apart while affixed to a food container.

Friction may also prevent the sleeve from coming apart. This also ensures a snug fit around a cup, preventing the sleeve from sliding down without the use of glue or adhesive. When in this position with a cup inserted, it is extremely difficult for the ends to become undone. When the cup is removed, the sleeve can be unfolded effortlessly into a napkin by removing the second lateral end portion from between the first inner and second outer portions 1181, 1182 of the second folded-over section 1180. Advantageously, the sleeve 100 may be removed from a cup, and unfolded and used as a napkin or paper towel. Thus, the sleeve 100 has multiple uses, unlike other existing cup sleeves, advantageously complementing the need for a napkin with the use of food related items. The sleeve 100 also does not unfold or come apart on its own when in the closed or open positions, and retains its structure until being unfolded by user.

Advantageously, the sleeve 100 may be used with iced/cold beverage containers/cups for iced beverages. Most iced beverage containers are constructed out of thin materials such as waxed paper, recyclable PET plastic or compostable PLA making the sidewall of these drinks extremely flexible and flimsy. As the cold liquid inside the cup reacts with the warm air outside, significant condensation is formed making the sidewall slippery and difficult to grip. The absorbent sleeve 100 is configured to soak up condensation while providing sturdiness and a better gripping surface.

Advantageously, the sleeve 100 is constructed using less material than most existing cup sleeves or double-walled insulated disposable cups. The sleeve 100 may be constructed from a paper towel material, which is a lower-density material than paper board used in other cup sleeves. This feature is advantageous because the sleeve 100 is lighter, thus reducing shipping costs, for example. The lower-density material may also provide further advantages as it is more environmentally friendly with lower environmental costs relating to manufacturing, shipping or waste.

In other embodiments, sleeve 100 may also be adjusted onto a bowl or other container. For example, by lengthening/pulling partially out the second lateral end portion from the second folded-over section 1180, the circumference of the sleeve 100 can be elongated in order to fit larger sized cups and bowls. Alternatively, the second lateral end portion can be folded over itself and tucked further into the second folded-over section 1180 in order to decrease the circumference to fit around smaller cups and cones. This adjustable feature is not a feature of alternatives that have a predetermined and fixed circumference.

Figure 12:
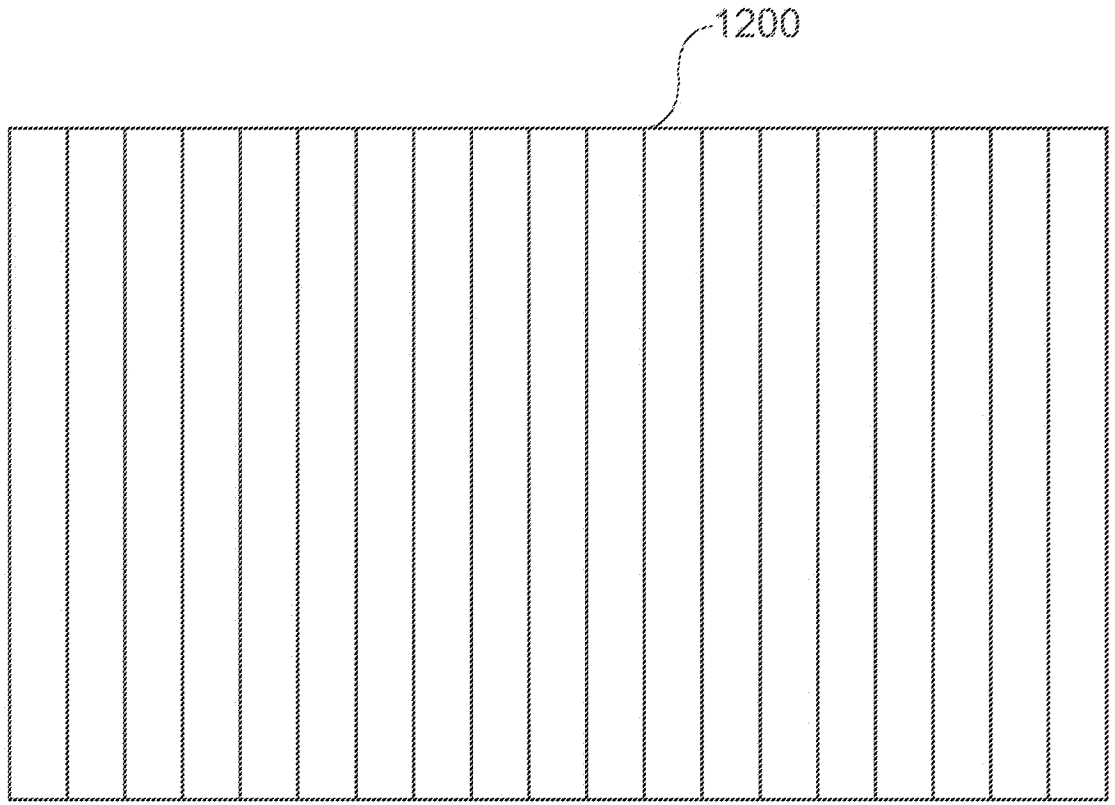
FIG. 12 illustrates an exemplary sheet of material having a textured pattern with raised grooves for manufacturing a container sleeve in accordance with the present disclosure.

In some embodiments, a sheet of material 1000 having textured properties may be used. For example, FIG. 12 shows a sheet of material 1200 having a textured pattern with raised grooves in accordance with an embodiment. The sheet of material 1200 may be a paper towel, for example.

Figure 13A:
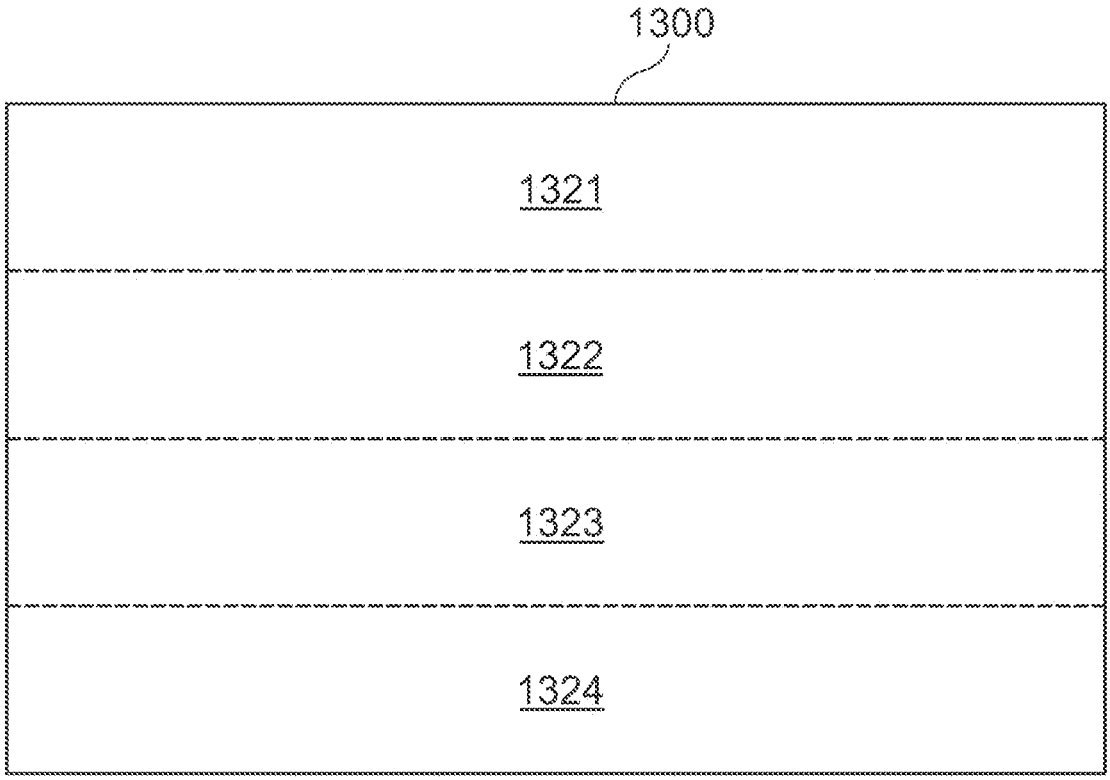
FIGS. 13A-13D illustrate an exemplary method of folding a sheet of material to form a sheet with a plurality of overlapping layers for manufacturing a container sleeve in accordance with the present disclosure.
Figure 13B:
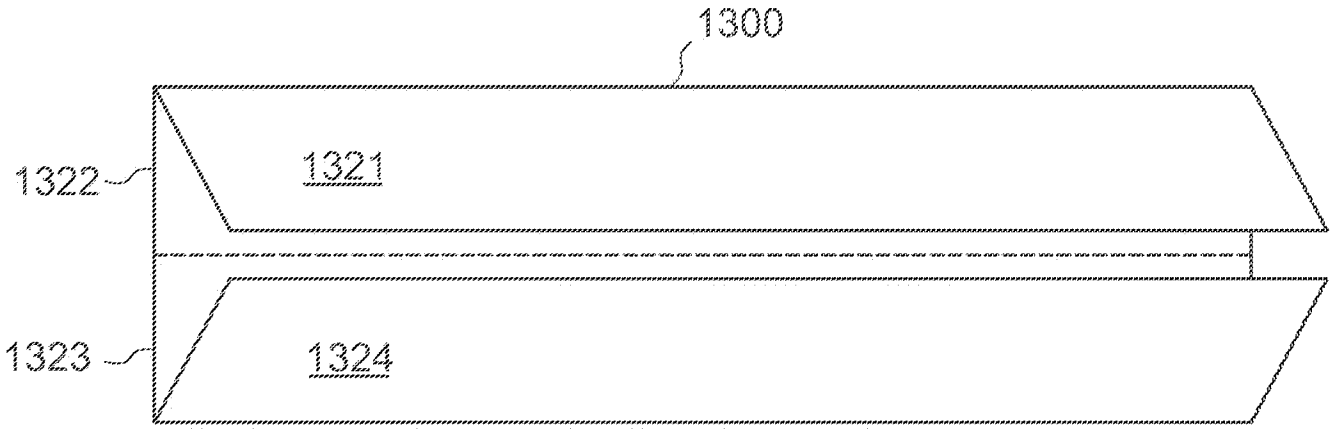
Figure 13C:
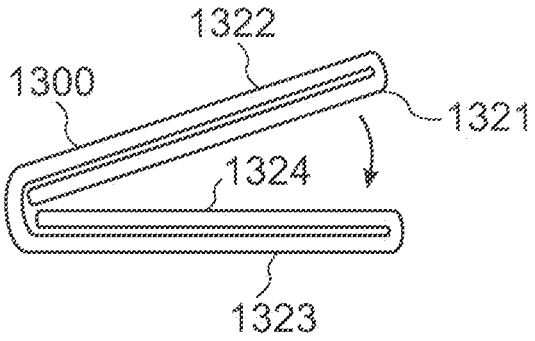
Figure 13D:
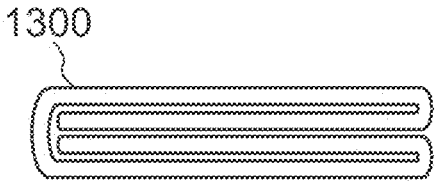

In some alternative embodiments, a sheet of material 1300 may be folded using other methods to produce a folded sheet of material with two long sides and two short sides to be used for making a sleeve according to the present disclosure, such as cup sleeve 100 of FIGS. 1-9. FIGS. 13A-13D show a method of folding a sheet of material 1300 to produce a folded material having four layers (four-ply) in accordance with an embodiment. Referring to FIG. 13A, four sections 1321, 1322, 1323, and 1324 are defined on a sheet of material 1300. Referring to FIG. 13B, section 1321 is folded over section 1322, and section 1324 is folded over section 1323. Referring to FIG. 13C, sections 1321 and 1322 are folded over sections 1323 and 1324. FIG. 13D illustrates the resulting folded sheet of material 1300 having four layers and a thickness equal to four times the thickness of the original material (four-ply).

Figure 14A:
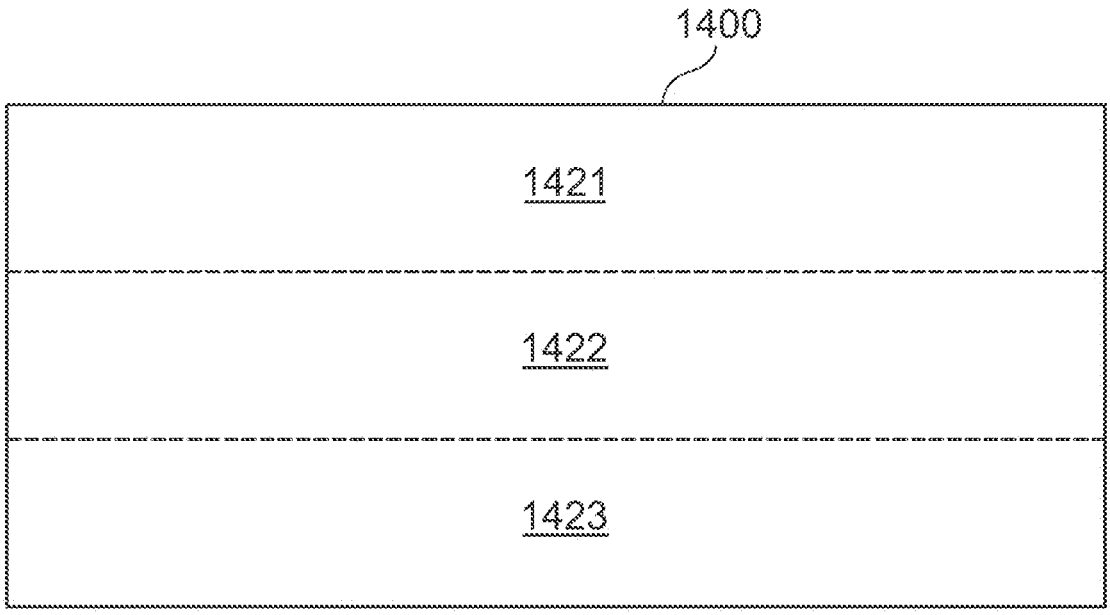
FIGS. 14A-14D illustrate another exemplary method of folding a sheet of material to form a sheet with a plurality of overlapping layers for manufacturing a container sleeve in accordance with the present disclosure.
Figure 14B:
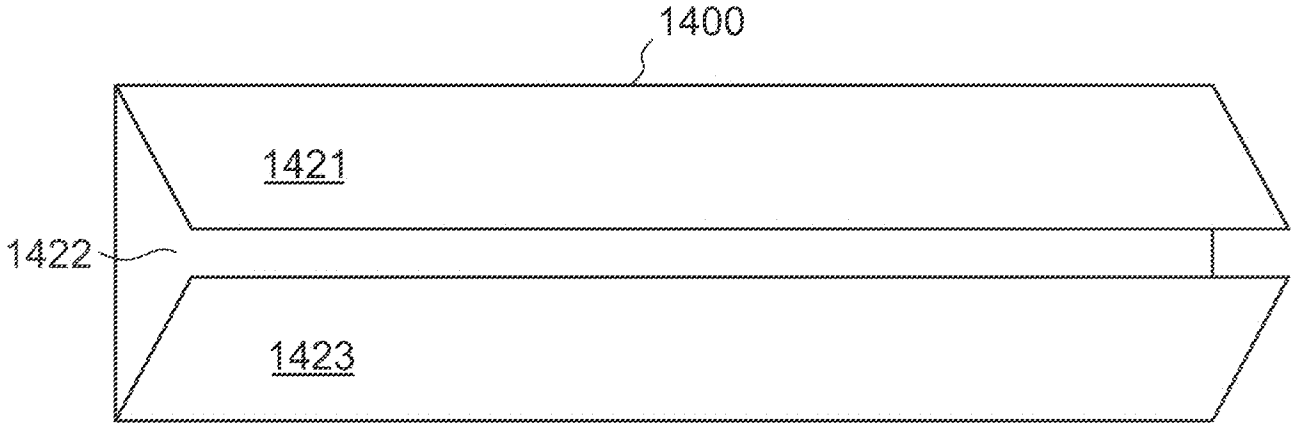
Figure 14C:
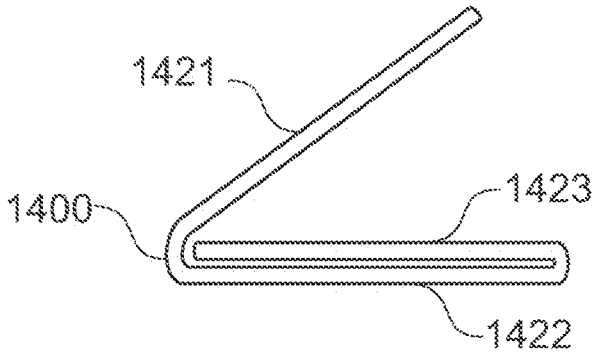
Figure 14D:
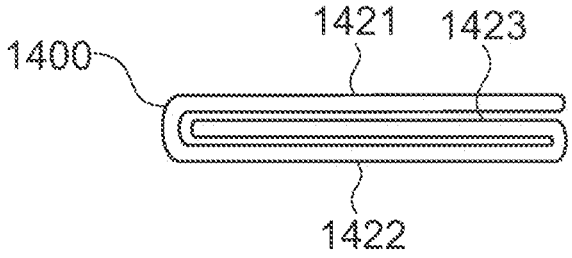

FIGS. 14A-14D show another method of folding a sheet of material 1400 to produce a folded sheet of material 1400 having three layers (three-ply) in accordance with an embodiment for making a sleeve according to the present disclosure, such as cup sleeve 100 of FIGS. 1-9. Referring to FIG. 14A, three sections 1421, 1422, and 1423 are defined on a sheet of material 1400. As shown in FIG. 14B, sections 1421 and 1423 are folded relative to section 1422. Referring to FIG. 14C, section 1423 is folded over section 1422, and then section 1421 is folded over section 1423. FIG. 14D illustrates the resulting folded sheet of material 1400 having three layers and a thickness equal to three times the thickness of the original material (three-ply).

Advantageously, the protection provided by the sleeves described herein has been compared to that of other cup sleeves and shown to be superior to those examples. In particular, the outside wall of the current sleeves 100 and that of various other cup sleeves were measured using an infrared heat thermometer. The procedure included the following steps. Cups having cup sleeves were filled with water heated to different temperatures. The cups were allowed to sit, allowing the cup sleeves to absorb any heat being transferred. The outside temperature of each cup sleeve was measured from 2 inches away using an infrared thermometer at different water temperatures measured with a digital thermometer inside the cup. The results showed that the sleeve 100 disclosed herein provides better protection qualities than most other alternative cup sleeves. For example, the sleeve 100 disclosed herein provided better protection than corrugated sleeves, especially at points near the palm of the user's hand.

It is to be understood that the above description is intended to be illustrative, and not restrictive. For example, the above-described examples (and/or aspects thereof) may be used in combination with each other. In addition, many modifications may be made to adapt a particular situation or material to the teachings of the various examples without departing from their scope. While dimensions and types of materials may be described herein, they are intended to define parameters of some of the various examples, and they are by no means limiting to all examples and are merely exemplary. All dimensions and shapes described herein are merely examples. In other embodiments, other dimensions, and other shapes, may be used.

Many other examples will be apparent to those of skill in the art upon reviewing the above description. The scope of the various examples should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," "third," etc. are used merely as reference labels, and are not intended to impose numerical, structural or other requirements on their objects. Forms of term "based on" herein encompass relationships where an element is partially based on as well as relationships where an element is entirely based on. Forms of the term "defined" encompass relationships where an element is partially defined as well as relationships where an element is entirely defined.

Further, the limitations of the following claims are not written in means-plus-function format and are not intended to be interpreted based on 35 U.S.C. § 112, sixth paragraph, unless and until such claim limitations expressly use the phrase "means for" followed by a statement of function cavity of further structure. It is to be understood that not necessarily all such objects or advantages described above may be achieved in accordance with any particular example. Thus, for example, those skilled in the art will recognize that the devices, systems and methods described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of examples, it should be readily understood that the disclosure is not limited to such disclosed examples. Rather, this disclosure can be modified to incorporate any number of variations, alterations, substitutions or equivalent arrangements not heretofore described, but which are commensurate with the spirit and scope of the disclosure. Additionally, while various examples have been described, it is to be understood that aspects of the disclosure may include only one example or some of the described examples. Also, while some disclosure are described as having a certain number of elements, it will be understood that the examples can be practiced with less than or greater than the certain number of elements.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

I claim:

1. A cup sleeve, comprising:

a sheet of material arranged into a sleeve configuration comprising an annular shape with a top edge, a bottom edge, a sleeve portion extending between the top and bottom edges, and an inner cavity formed by an interior face of the sleeve portion that is open at the top and bottom edges and defines an axis, the sleeve portion configured to engage with an outer circumference of a cup when positioned within the inner cavity, wherein the sheet of material comprises a pliable, liquid absorbent material configured to be thermally insulative to the cup, wherein, in the sleeve configuration with the axis of the cavity oriented vertically, the sleeve portion is angled along a height direction extending vertically such that a first side of the sleeve portion is positioned higher than a second side of the sleeve portion, and wherein, in the sleeve configuration, a first lateral end portion of the sheet of material is folded over the top edge or the bottom edge of a second lateral end portion of the sheet of material such that a terminal end portion of the second lateral end portion extends under an outer portion of the first lateral end portion of the sheet of material and over an inner portion of the first lateral end portion of the sheet of material.

2. The cup sleeve according to claim 1, wherein the first and second sides of the sleeve portion are substantially opposing sides of the annular shape.

3. The cup sleeve according to claim 1, wherein, in the sleeve configuration with the axis of the cavity oriented vertically, the top edge is angled along the height direction such that a first point of the top edge is positioned higher than a second point of the of the top edge.

4. The cup sleeve according to claim 3, wherein, in the sleeve configuration with the axis of the cavity oriented vertically, the bottom edge is angled along the height direction such that a first point of the bottom edge is positioned higher than a second point of the of the bottom edge.

5. The cup sleeve according to claim 1, wherein the cup sleeve consists of the sheet of material.

6. The cup sleeve according to claim 1, wherein the sheet of material comprises a plurality of overlapping layers.

7. The cup sleeve according to claim 1, wherein, in the sleeve configuration, the second lateral end portion is freely positioned between the outer and inner portions of the first lateral end portion of the sheet of material.

8. The cup sleeve according to claim 1, wherein, in the sleeve configuration, the sleeve comprises a first portion having a first number of overlapping layers of the sheet of material, and a second portion having a second number of overlapping layers of the sheet of material that is three times the first number of overlapping layers.

9. The cup sleeve according to claim 8, wherein, in the sleeve configuration, the second lateral end portion, the outer portion of the first lateral end portion of the sheet of material and the inner portion of the first lateral end portion of the sheet of material overlap each other and form the second portion of the sleeve.

10. The cup sleeve according to claim 9, wherein, in the sleeve configuration, a medial portion of the sheet of material that extends between the first and second lateral end portions forms the first portion of the sleeve.

11. The cup sleeve according to claim 1, wherein the inner portion of the first lateral end portion of the sheet of material is a lateral end corner portion of the first lateral end portion of the sheet of material.

12. The cup sleeve according to claim 1, wherein the lateral end portion comprises a triangular shaped portion.

13. The cup sleeve according to claim 1, wherein the sheet of material has a water absorbency rate of at least 0.1 g/see for at least the first 2 seconds of water contact and at least 0.025 g/see for at least the first 5 seconds of water contact, and a detached water capacity of at least 0.01 g/in$^2$.

14. The cup sleeve according to claim 1, wherein, in the sleeve configuration, the inner cavity is of a conical shape with a top end being larger and a bottom end thereof.

15. The cup sleeve according to claim 1, wherein the sheet of material is freely manually rearrangeable from the sleeve configuration to a second open configuration, wherein the sheet of material is operable as a liquid absorbent towel or napkin in the second open configuration.

16. A method of forming a cup sleeve, comprising:

obtaining a pliable, liquid absorbent and thermally insulative sheet of material; and forming the sheet of material into a cup sleeve configuration comprising an annular shape with a top edge, a bottom edge, a sleeve portion extending between the top and bottom edges, and an inner cavity that is open at the top and bottom edges and defines an axis, the sleeve portion configured to engage with an outer circumference of a cup positioned within the inner cavity, wherein, in the sleeve configuration with the axis of the inner cavity oriented vertically, the sleeve portion is angled along a height direction extending vertically such that a first side of the sleeve portion is positioned higher than a second side of the sleeve portion, and wherein forming the sheet to material into the cup sleeve configuration includes folding a first lateral end portion of the sheet of material over the top edge or the bottom edge of a second lateral end portion of the sheet of material such that a terminal end portion of the second lateral end portion extends under an outer portion of the first lateral end portion of the sheet of material and over an inner portion of the first lateral end portion of the sheet of material.

17. The method according to claim 16, wherein, in the sleeve configuration with the axis of the cavity oriented vertically, the top edge is angled along the height direction such that a first point of the top edge is positioned higher than a second point of the of the top edge.

18. The method according to claim 17, wherein, in the sleeve configuration with the axis of the cavity oriented vertically, the bottom edge is angled along the height direction such that a first point of the bottom edge is positioned higher than a second point of the of the bottom edge.

19. The method according to claim 16, wherein the inner portion of the first lateral end portion of the sheet of material is a lateral end corner portion of the first lateral end portion of the sheet of material.

20. The method according to claim 16, wherein forming the sheet of material into the cup sleeve configuration comprises forming a first portion having a first number of overlapping layers of the sheet of material, and a second portion having a second number of overlapping layers of the sheet of material that is three times the first number of overlapping layers.

* * * * *